US010577206B2

(12) United States Patent
Okubo et al.

(10) Patent No.: US 10,577,206 B2
(45) Date of Patent: Mar. 3, 2020

(54) IMAGE FORMING APPARATUS AND CONVEYANCE CONTROL METHOD

(71) Applicant: KONICA MINOLTA, INC., Tokyo (JP)

(72) Inventors: Takahiro Okubo, Kanagawa (JP); Yasuo Shiokawa, Tokyo (JP); Yoshiteru Kawakami, Tokyo (JP)

(73) Assignee: KONICA MINOLTA, INC., Chiyoda-ku, Tokyo (JP)

( * ) Notice: Subject to any disclaimer, the term of this patent is extended or adjusted under 35 U.S.C. 154(b) by 0 days.

(21) Appl. No.: 16/026,161

(22) Filed: Jul. 3, 2018

(65) Prior Publication Data

US 2019/0010003 A1 Jan. 10, 2019

(30) Foreign Application Priority Data

Jul. 4, 2017 (JP) ..... 2017-131208
Jul. 5, 2017 (JP) ..... 2017-131902
Jul. 6, 2017 (JP) ..... 2017-132867

(51) Int. Cl.
*B65H 9/00* (2006.01)
*B65H 5/06* (2006.01)
(Continued)

(52) U.S. Cl.
CPC ..... *B65H 9/002* (2013.01); *B65H 5/062* (2013.01); *B65H 9/20* (2013.01); *G03G 15/6564* (2013.01);
(Continued)

(58) Field of Classification Search
CPC ..... B65H 9/002; B65H 29/68; G03G 2215/00945; G03G 2215/00949; G03G 2215/0196
See application file for complete search history.

(56) References Cited

U.S. PATENT DOCUMENTS 6,356,735 B1 3/2002 Hozumi
6,453,149 B1 * 9/2002 Dobbertin ..... B65H 9/002 399/388
(Continued)

FOREIGN PATENT DOCUMENTS

EP 2713215 A2 4/2014
JP 2014-133634 7/2014

OTHER PUBLICATIONS

Extended European Search Report dated Nov. 9, 2018, issued by the European Patent Office in corresponding European Application No. 18181132.4. (8 pages).

*Primary Examiner* — Howard J Sanders
(74) *Attorney, Agent, or Firm* — Buchanan Ingersoll & Rooney PC

(57) ABSTRACT

An image forming apparatus includes: a transfer section that transfers an image onto a sheet; a sheet conveying member that conveys the sheet, the sheet conveying member being provided upstream of the transfer section in a sheet conveyance direction; and a hardware processor that controls displacement of the sheet conveying member so that the sheet is displaced along a width direction of the sheet. The hardware processor sets a displacement speed of the sheet conveying member for the sheet during transfer of the image by the transfer section to be lower than the displacement speed of the sheet conveying member for the sheet before the transfer of the image by the transfer section.

20 Claims, 12 Drawing Sheets

(51) Int. Cl.

| | |
|---|---|
| ***B65H 9/20*** | (2006.01) |
| ***G03G 15/00*** | (2006.01) |
| *B65H 29/68* | (2006.01) |

(52) U.S. Cl.
CPC ..... *G03G 15/6567* (2013.01); *B65H 29/68* (2013.01); *G03G 2215/00945* (2013.01)

(56) References Cited

U.S. PATENT DOCUMENTS

| | | | | |
|---|---|---|---|---|
| 9,158,262 | B2 * | 10/2015 | Kawanago ..... | G03G 15/6558 |
| 2007/0264066 | A1 * | 11/2007 | Peng ..... | G03G 15/5062 399/395 |
| 2010/0109229 | A1 | 5/2010 | Iwakawa | |
| 2014/0064813 | A1 | 3/2014 | Yoshimura et al. | |
| 2014/0086598 | A1 | 3/2014 | Kawanago et al. | |

* cited by examiner

IMAGE FORMING APPARATUS AND CONVEYANCE CONTROL METHOD

CROSS REFERENCE TO RELATED APPLICATIONS

The entire disclosure of Japanese Patent Application No. 2017-131208 filed on Jul. 4, 2017, No. 2017-131902 filed on Jul. 5, 2017 and No. 2017-132867 filed on Jul. 6, 2017 are incorporated herein by reference in these entirety.

BACKGROUND

Technological Field

The present invention relates to an image forming apparatus and a conveyance control method.

Description of Related Art

In general, an image forming apparatus (such as a printer, a copier, and a facsimile machine) using an electrophotographic processing technique applies (exposes) laser light on the basis of image data to a charged photoconductor drum (image bearing member) to form an electrostatic latent image. In the image forming apparatus, a developing unit supplies toner to the photoconductor drum provided with the electrostatic latent image to visualize the electrostatic latent image to form a toner image. The image forming apparatus further primarily or secondarily transfers the toner image to a sheet and heats and pressurizes the sheet by a fixing nip of a fixing unit to fix the toner image on the sheet. Also, in the image forming apparatus, registration rollers that correct positional deviation in a width direction of a sheet are provided upstream of a transfer section that transfers an image onto a sheet (see, for example, Japanese Patent Application Laid-Open No. 2014-133634 (hereinafter referred to as "PTL 1")).

By the way, the image forming apparatus has a problem of occurrence of a phenomenon (sub scanning obliqueness) in that a conveyance direction of the sheet is passed obliquely in a sub scanning direction due to misalignment from the registration rollers to the fixing nip through the transfer section. In addition to the case of the misalignment, the sub scanning obliqueness is likely to occur when there is a difference between the diameters at opposite ends of the rollers in the sheet width direction (sub scanning direction) due to a durability issue or the like. A long sheet with a long size in the conveyance direction is easily affected, and the sub scanning obliqueness often occurs. The sub scanning obliqueness leads to a poor image due to deviation, distortion, or the like of the image transferred at the transfer section, and a technique for reducing the sub scanning obliqueness is demanded.

For example, in PTL 1, a registration displacement control technique in which a line sensor is provided between the registration rollers and a transfer roller, a position of an edge in a width direction (side edge) of a sheet is detected by the line sensor and the registration rollers are moved based on a result of the detection.

However, conventional registration displacement control techniques only address registration displacement before image transfer, that is, before a sheet reaches a transfer nip and are delayed in study of registration displacement during image transfer. Therefore, in conventional image forming apparatuses, no registration displacement control suitable for a sheet that is likely to cause sub scanning obliqueness during image transfer, like, for example, a long sheet, is performed, and sub scanning obliqueness of such sheet may fail to be properly corrected, resulting in occurrence of an image defect.

In view of such circumstances, the present inventors conducted tests of registration displacement during image transfer, that is, during conveyance of a sheet by a transfer section, under various conditions, and as a result, found the problem that an image defect may occur due to transmission of vibration caused by registration displacement to the transfer section.

SUMMARY

An object of the present invention is to provide an image forming apparatus and a conveyance control method that enable preventing generation of a defective image due to transmission of vibration during displacement to a transfer section and thus enable correction of sub scanning obliqueness of a sheet that is being subjected to image transfer.

In order to realize at least one of the above objects, an image forming apparatus reflecting an aspect of the present invention includes: a transfer section that transfers an image onto a sheet; a sheet conveying member that conveys the sheet, the sheet conveying member being provided upstream of the transfer section in a sheet conveyance direction; and a control unit that controls displacement of the sheet conveying member so that the sheet is displaced along a width direction of the sheet, in which the control unit sets a displacement speed of the sheet conveying member for the sheet during transfer of the image by the transfer section to be lower than the displacement speed of the sheet conveying member for the sheet before the transfer of the image by the transfer section.

In order to realize at least one of the above objects, a conveyance control method reflecting an aspect of the present invention includes a transfer section that transfers an image onto a sheet and a sheet conveying member that conveys the sheet, the sheet conveying member being provided upstream of the transfer section in a sheet conveyance direction, the sheet conveying member being displaced so that the sheet is displaced along a width direction of the sheet, the method including setting a displacement speed of the sheet conveying member for the sheet during transfer of the image by the transfer section to be lower than the displacement speed of the sheet conveying member for the sheet before the transfer of the image by the transfer section.

BRIEF DESCRIPTION OF DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 3A illustrates a state before displacement of a registration roller pair and FIG. 3B is a state after the displacement of the registration roller pair;

FIG. 4A illustrates a state in which a loop of a sheet is maintained and FIG. 4B illustrates a state in which a loop of a sheet fails to be maintained;

DETAILED DESCRIPTION OF EMBODIMENTS

Hereinafter, one or more embodiments of the present invention will be described with reference to the drawings. However, the scope of the invention is not limited to the disclosed embodiments.

Embodiment 1

Figure 1:
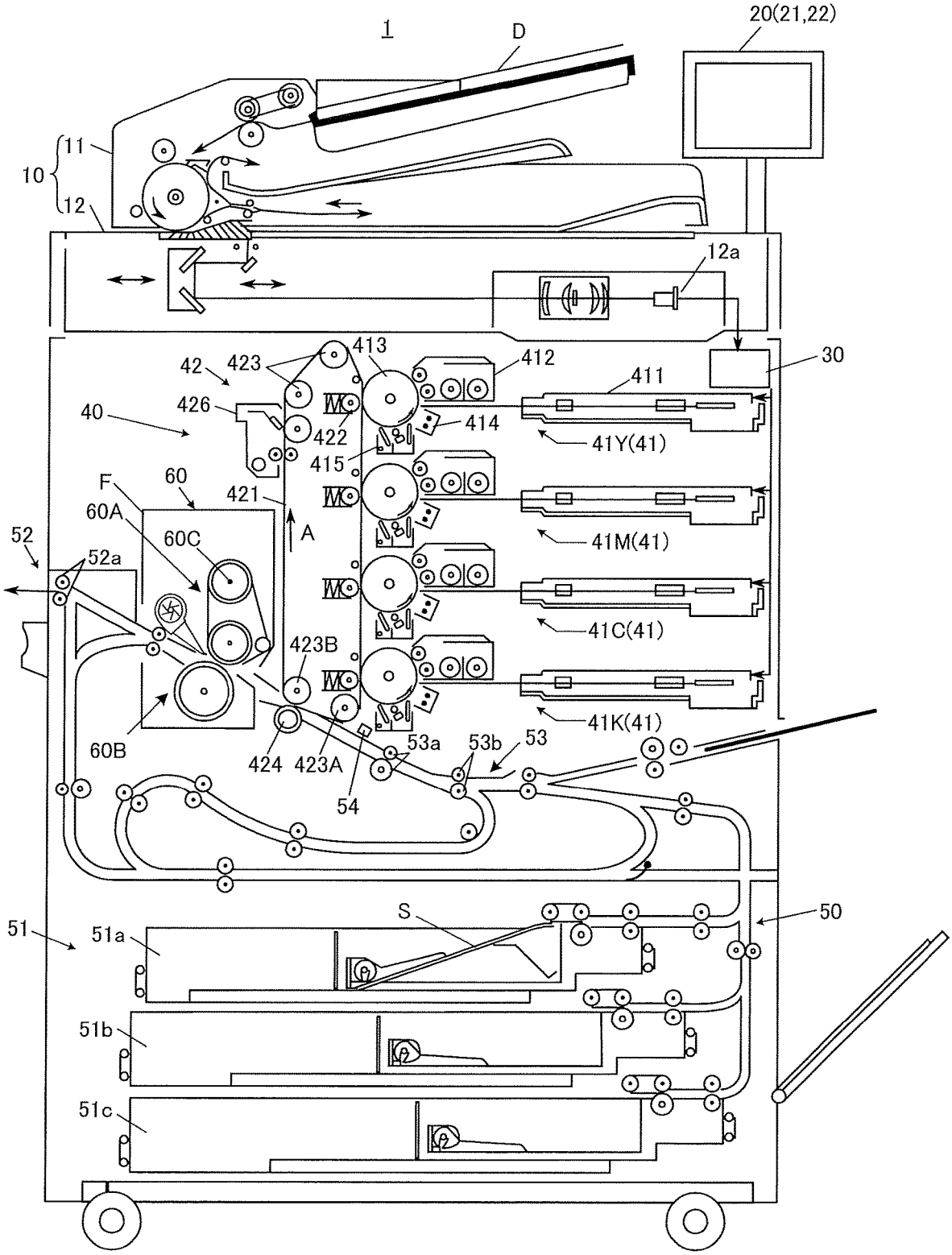
FIG. 1 is a diagram schematically illustrating an overall configuration of an image forming apparatus according to Embodiment 1.
Figure 2:
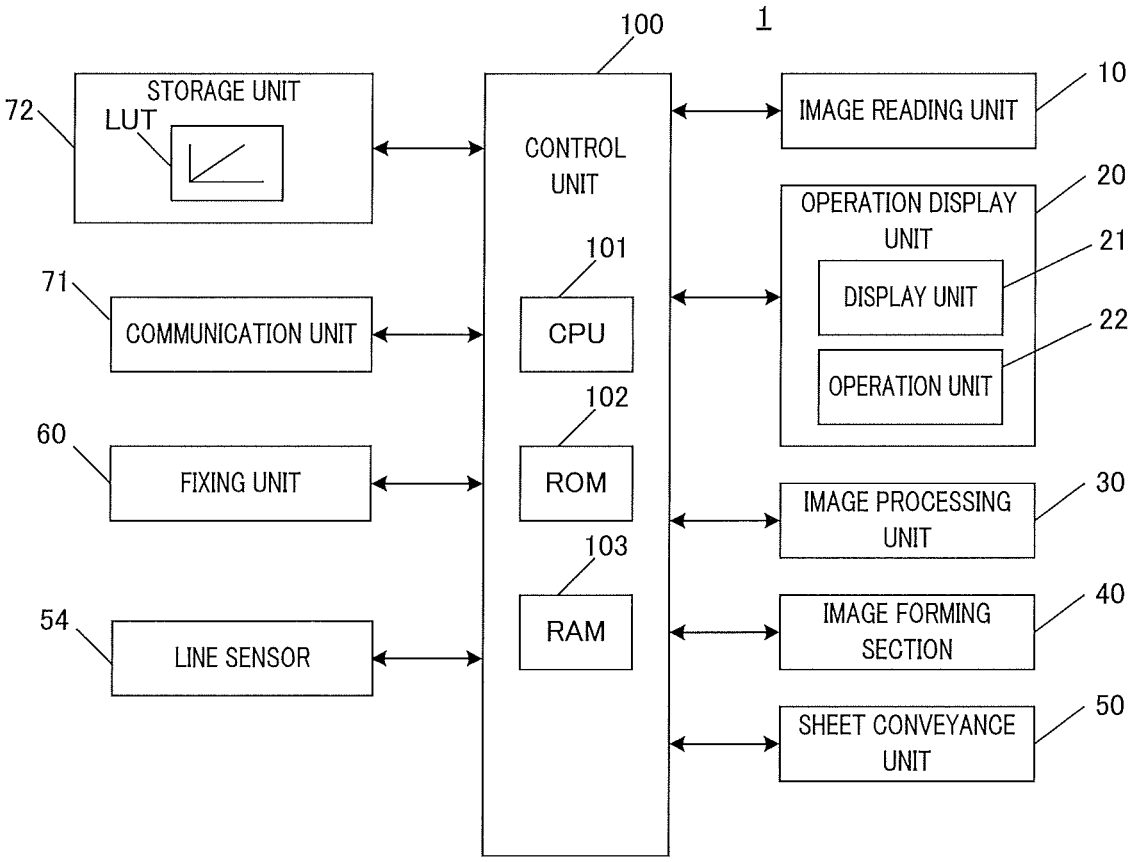
FIG. 2 is a block diagram showing main parts of a control system of the image forming apparatus of FIG. 1.

FIG. 1 is a diagram schematically illustrating an overall configuration of image forming apparatus 1 according to Embodiment 1. FIG. 2 shows main parts of a control system of image forming apparatus 1 of FIG. 1.

Image forming apparatus 1 of the present Embodiment uses a long sheet or a non-long sheet as sheet S and forms an image on sheet S.

In the present embodiment, the long sheet is a piece of paper longer in a conveyance direction than regularly used sheets, such as A4-sized and A3-sized sheets. In the following description, a paper sheet simply referred to as a "sheet" can be either a long sheet or a non-long sheet.

Image forming apparatus 1 is a color image forming apparatus of an intermediate transfer system using an electrophotographic process technique. More specifically, image forming apparatus 1 primarily transfers toner images of colors Y (yellow), M (magenta), C (cyan), and K (black) formed on photoconductor drums 413 to intermediate transfer belt 421 and places the toner images of four colors on top of each other on intermediate transfer belt 421. Image forming apparatus 1 then secondarily transfers the toner images to the sheet to form a toner image.

A tandem system is adopted in image forming apparatus 1, in which photoconductor drums 413 corresponding to four colors of YMCK are disposed in series in a traveling direction of intermediate transfer belt 421, and the toner images of the colors are sequentially transferred to intermediate transfer belt 421 in one procedure.

As shown in FIG. 2, image forming apparatus 1 includes image reading unit 10, operation display unit 20, image processing unit 30, image forming section 40, sheet conveyance unit 50, fixing unit 60, control unit 100, and the like.

Control unit 100 includes CPU (Central Processing Unit) 101, ROM (Read Only Memory) 102, RAM (Random Access Memory) 103, and the like. CPU 101 reads a program according to details of processing from ROM 102 and loads the program in RAM 103. CPU 101 comprehensively controls the operation of blocks of image forming apparatus 1 in cooperation with the loaded program. In this case, CPU 101 references various types of data stored in storage unit 72. Storage unit 72 includes, for example, a non-volatile semiconductor memory (so-called flash memory) or a hard disk drive.

Control unit 100 transmits and receives various types of data to and from an external apparatus (for example, personal computer) connected to a communication network, such as LAN (Local Area Network) and WAN (Wide Area Network), through communication unit 71. For example, control unit 100 receives image data transmitted from the external apparatus and forms a toner image on the sheet based on the image data (input image data). Communication unit 71 includes, for example, a communication control card such as a LAN card.

Image reading unit 10 includes automatic original sheet feeding apparatus 11 called an ADF (Auto Document Feeder), original image scanning apparatus 12 (scanner), and the like.

Automatic original sheet feeding apparatus 11 conveys original D mounted on an original tray based on a conveyance mechanism and sends out original D to original image scanning apparatus 12. Automatic original sheet feeding apparatus 11 can continuously read, without pausing, images (including double-sided) of many pieces of original D mounted on the original tray.

Original image scanning apparatus 12 optically scans the original conveyed onto a contact glass from automatic original sheet feeding apparatus 11 or the original mounted on the contact glass and forms an image on a light-receiving surface of CCD (Charge Coupled Device) sensor 12*a* based on reflected light from the original to thereby read the original image. Image reading unit 10 generates input image data based on the reading result of original image scanning apparatus 12. Image processing unit 30 applies predetermined image processing to the input image data.

Operation display unit 20 includes, for example, a liquid crystal display (LCD) with a touch panel and functions as display unit 21 and operation unit 22. Display unit 21 displays various operation screens, states of images, operation conditions of functions, and the like according to display control signals input from control unit 100. Operation unit 22 includes various operation keys, such as numeric keys and a start key. Operation unit 22 receives various input operations by the user and outputs operation signals to control unit 100.

Image processing unit 30 includes a circuit or the like that applies digital image processing to the input image data according to initial setting or user setting. For example, image processing unit 30 performs tone correction based on tone correction data (tone correction table LUT) in storage unit 72 under the control of control unit 100. Other than the tone correction, image processing unit 30 also applies various correction processes, such as color correction and shading correction, compression processing, and the like to the input image data. Image forming section 40 is controlled based on the processed image data.

Image forming section 40 includes: image forming units 41Y, 41M, 41C, and 41K that form images using colored toners of Y component, M component, C component, and K component based on the input image data; intermediate transfer unit 42; and the like.

Image forming units 41Y, 41M, 41C, and 41K for Y component, M component, C component, and K component have similar configurations. For the convenience of the illustration and the description, common constituent elements are indicated by the same reference signs, and Y, M, C and K are attached to the reference signs to distinguish the constituent elements. In FIG. 1, the reference signs are provided only to the constituent elements of image forming unit 41Y for Y component, and the reference signs are not illustrated for the constituent elements of the other image forming units 41M, 41C, and 41K.

Image forming unit 41 includes exposing device 411, developing device 412, photoconductor drum 413, charging device 414, drum cleaning apparatus 415, and the like.

Photoconductor drum 413 is, for example, a negative charge type organic photo-conductor (OPC) including an under coat layer (UCL), a charge generation layer (CGL), and a charge transport layer (CTL) sequentially laminated on a peripheral surface of an aluminum conductive cylindrical body (aluminum tube). The charge generation layer is made of an organic semiconductor in which a charge generation material (for example, phthalocyanine pigment) is dispersed on a resin binder (for example, polycarbonate), and the charge generation layer generates a pair of positive charge and negative charge based on exposure by exposing device 411. The charge transport layer is a layer in which a hole transport material (electron-donating nitrogen-containing compound) is dispersed on a resin binder (for example, polycarbonate resin), and the charge transport layer transports the positive charge generated by the charge generation layer to the surface of the charge transport layer.

Control unit 100 rotates photoconductor drum 413 at a constant circumferential speed (linear speed) by controlling a drive current supplied to a drive motor (not shown) that rotates photoconductor drum 413.

Charging device 414 uniformly applies a negative charge to the photoconductive surface of photoconductor drum 413. Exposing device 411 includes, for example, a semiconductor laser and applies laser light to photoconductor drum 413 according to the image of each color component. As a result, an electrostatic latent image of each color component is formed on the surface of photoconductor drum 413 due to the potential difference between the surface and the surroundings.

Developing device 412 is, for example, a two-component development type developing device, and developing device 412 attaches the toner of each color component to the surface of photoconductor drum 413 to visualize the electrostatic latent image to form the toner image.

Drum cleaning apparatus 415 includes a cleaning blade or the like brought into sliding contact with the surface of photoconductor drum 413. A cleaning blade in drum cleaning apparatus 415 removes the remaining transfer toner left on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning apparatus 426, and the like.

Intermediate transfer belt 421 includes an endless belt and is stretched by a plurality of support rollers 423 in a loop shape. At least one of support rollers 423 is a driving roller, and other support rollers 423 are driven rollers. For example, it is preferable that roller 423A disposed on the downstream of primary transfer roller 422 for K component in the belt traveling direction be a driving roller. As a result, the traveling speed of the belt in the primary transfer section can be easily maintained at a constant speed. Driving roller 423A rotates, and intermediate transfer belt 421 travels at a constant speed in an arrow A direction.

Primary transfer roller 422 faces photoconductor drum 413 of each color component and is disposed on an inner peripheral side of intermediate transfer belt 421. Primary transfer roller 422 is pressed against photoconductor drum 413 across intermediate transfer belt 421, and a primary transfer nip for transferring the toner image from photoconductor drum 413 to intermediate transfer belt 421 is formed.

Secondary transfer roller 424 faces backup roller 423B disposed on the downstream of driving roller 423A in the belt traveling direction, and secondary transfer roller 424 is disposed on an outer peripheral side of intermediate transfer belt 421. Secondary transfer roller 424 is pressed against backup roller 423B across intermediate transfer belt 421, and a secondary transfer nip for transferring the toner image from intermediate transfer belt 421 to sheet S is formed.

The secondary transfer nip formed by intermediate transfer belt 421, backup roller 423B, and secondary transfer roller 424 corresponds to a "transfer section" of the present invention.

When intermediate transfer belt 421 passes through the primary transfer nip, the toner images on photoconductor drums 413 are primarily transferred to intermediate transfer belt 421 and sequentially placed on top of each other. Specifically, a primary transfer bias is applied to primary transfer roller 422 to provide a charge with a polarity opposite the toner to the side of intermediate transfer belt 421 coming into contact with primary transfer roller 422, and the toner images are electrostatically transferred to intermediate transfer belt 421.

Subsequently, when the sheet passes through the secondary transfer nip, the toner images on intermediate transfer belt 421 are secondarily transferred to the sheet. Specifically, a secondary transfer bias is applied to secondary transfer roller 424 to provide a charge with a polarity opposite the toner to the side of the sheet coming into contact with secondary transfer roller 424, and the toner images are electrostatically transferred to the sheet. The sheet provided with the toner images is conveyed toward fixing unit 60.

Belt cleaning apparatus 426 includes a belt cleaning blade or the like in sliding contact with the surface of intermediate transfer belt 421 and removes the remaining transfer toner left on the surface of intermediate transfer belt 421 after the secondary transfer.

Fixing unit 60 includes: upper fixing unit 60A including a fixing surface member disposed on the fixing surface side of the sheet; lower fixing unit 60B including a back surface support member disposed on the opposite side of the fixing surface of the sheet; heat source 60C; and the like. The back surface support member is pressed against the fixing surface member to form a fixing nip for sandwiching and conveying the sheet.

Fixing unit 60 fixes the toner image to the sheet by heating and pressurizing, in the fixing nip, the conveyed sheet on which the toner images have been secondarily transferred. Fixing unit 60 is disposed as a unit in fixing device F.

Sheet conveyance unit 50 includes sheet feeding unit 51, sheet ejection unit 52, conveyance path unit 53, and the like. Three sheet feed tray units 51*a* to 51*c* of sheet feeding unit 51 hold sheets S (standard sheets, special sheets) according to preset types identified based on the basis weight (stiffness), the size, and the like. Conveyance path unit 53 includes a plurality of conveyance rollers, such as registration roller pair 53*a* and loop rollers 53*b*, a double-sided conveyance path for forming images on both sides of the sheet, and the like. Registration roller pair 53*a* corresponds to a "sheet conveyance member" of the present invention.

Registration roller pair 53*a* corrects the position of sheet S in the width direction under the control of control unit 100. In other words, upon sheet S being sandwiched between nips of registration roller pair 53*a*, control for displacement operation (registration displacement) to move registration roller pair 53*a* in the width direction and thereby move sheet S is performed, and the position in the width direction of sheet S is thereby corrected. In the present embodiment, as a drive source for displacement of registration roller pair 53*a*, a stepping motor is used. Details of the content of the registration displacement control will be described later.

Loop rollers 53*b* are a pair of rollers disposed upstream of registration roller pair 53*a* in the conveyance direction. Loop rollers 53*b* rotate under the control of control unit 100 in such a way that sheet S is looped in the space between registration roller pair 53*a* and loop rollers 53*b* to correct obliqueness of sheet S.

Registration roller pair 53*a* is separated after the correction of the position of sheet S in the width direction, before sheet S finishes passing through registration roller pair 53*a*, that is, in the middle of the conveyance of sheet S, and is returned to the position before the movement. Registration roller pair 53*a* is pressed and attached again after the rear-end of sheet S passes through registration roller pair 53*a*.

Under the control of control unit 100, the conveyance speed of sheet S at registration roller pair 53*a* is set faster than the conveyance speed of sheet S at the secondary transfer nip formed by backup roller 423B and secondary transfer roller 424. Thus, a toner image is formed on an upper surface of sheet S transferred to the secondary transfer nip while sheet S is being conveyed such that a loop (slack) is formed between the secondary transfer nip and registration roller pair 53*a*.

Line sensor 54 is disposed on the downstream of registration roller pair 53*a* and the upstream of the secondary transfer nip in the sheet conveyance direction. Line sensor 54 is a sensor that is formed of linearly arranged photoelectric conversion elements and serves as a component that detects a one-side edge of sheet S in the width direction thereof (hereinafter referred to as side edge) to sense an offset of sheet S (deviation from reference position).

Sheets S housed in sheet feed tray units 51*a* to 51*c* are sent out piece by piece from the top and are conveyed by conveyance path unit 53 to image forming section 40. In this case, registration roller pair 53*a* corrects (skew corrects) the inclination of the fed sheet S and adjusts the conveyance timing.

In image forming section 40, the toner images of intermediate transfer belt 421 are secondarily transferred altogether to one of the surfaces of sheet S, and a fixing process is applied by fixing unit 60. Sheet ejection unit 52 including sheet ejection roller 52*a* ejects sheet S provided with the images to the outside of the apparatus. Note that during double-sided printing, sheet S after the image formation on a first surface passes through the double-sided conveyance path, and the front and the back are inverted. The toner images are secondarily transferred and fixed to a second surface, and sheet ejection unit 52 ejects sheet S to the outside of the apparatus.

By the way, the image forming apparatus has a problem of a phenomenon that the conveyance direction of the sheet is passed obliquely in the sub scanning direction (sub scanning obliqueness) due to misalignment from the registration roller pair 53*a* to the fixing nip through the secondary transfer nip. In addition to the misalignment, the sub scanning obliqueness is also likely to occur when there is a difference between the diameters at opposite ends of the rollers in the sheet width direction (sub scanning direction) due to a durability issue or the like. The long sheet with a long size in the conveyance direction is easily affected, and the sub scanning obliqueness often occurs (see FIG. 5). The sub scanning obliqueness leads to a poor image due to deviation or distortion of the image transferred at the transfer section, and a technique of reducing the sub scanning obliqueness is demanded.

Figure 3A:
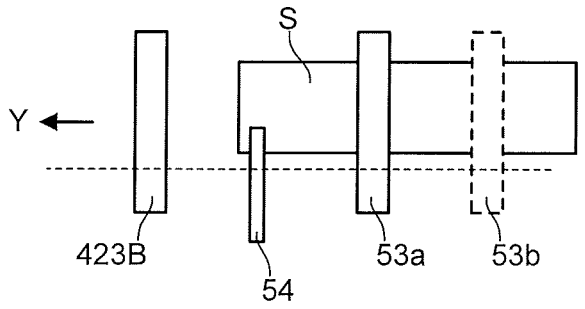
FIGS. 3A and 3B are diagrams illustrating conventional control of registration displacement.
Figure 3B:
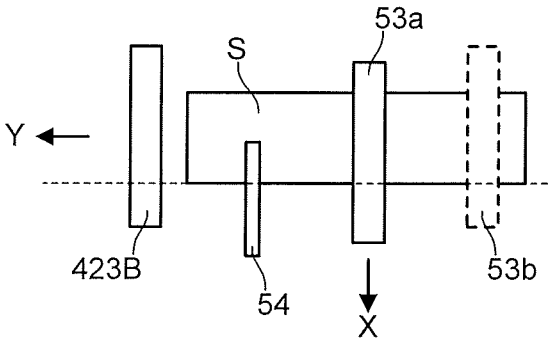

FIGS. 3A and 3B are diagrams illustrating conventional registration displacement control, in which arrow Y denotes a conveyance direction of sheet S, the alternate long and short dash line denotes a reference end position (target position) for sheet S detected by line sensor 54 and arrow X denotes a direction of displacement of registration roller pair 53*a*. Further, a roller separates from sheet S is drawn with the dotted line.

FIG. 3A illustrates an example in which sheet S (long sheet) is so conveyed as to be passed obliquely rightward (toward far side) as a whole in a position upstream of backup roller 423B, which forms the secondary transfer nip. In this case, control unit 100 detects a direction and an amount of deviation of a side edge of sheet S from an output signal from line sensor 54 and determines a direction of displacement of registration roller pair 53*a* and calculates an amount of the displacement from a result of the detection. Then, as illustrated in FIG. 3B, control unit 100 performs control to displace registration roller pair 53*a* in the X direction orthogonal to the sheet conveyance direction Y according to results of the determination and the calculation.

To perform the registration displacement control, control unit 100 further causes rollers upstream of registration roller pair 53*a* (loop rollers 53*b* in example illustrated in FIGS. 3A and 3B) in the conveyance direction to be separate away from sheet S. Sheet S is therefore conveyed only with registration roller pair 53*a* (hereinafter referred to as registration nip) before and after the period for which the registration roller pair 53*a* is displaced.

However, such conventional technique only addresses registration displacement before image transfer, that is, before sheet S reaches the secondary transfer nip, and is delayed in study of registration displacement during image transfer. Therefore, in conventional image forming apparatuses, no registration displacement control suitable for a sheet that is likely to cause sub scanning obliqueness during image transfer, like, for example, a long sheet, is performed, and sub scanning obliqueness of such sheet may fail to be properly corrected, resulting in generation of a defective image.

In view of such circumstances, the present inventors conducted tests of displacement of registration roller pair 53*a* during transfer of an image onto a sheet, and as a result, obtained the following knowledge. The knowledge, etc., obtained by the present inventors will be described below with reference to FIGS. 4A and 4B. Here, FIGS. 4A and 4B each illustrate a state in which registration roller pair 53*a* is displaced when a toner image is being transferred via the secondary transfer nip.

Figure 4A:
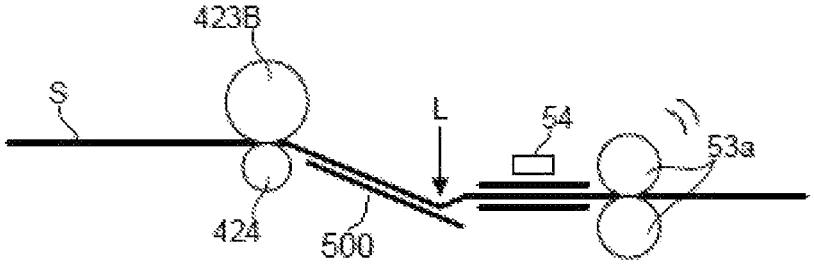
FIGS. 4A and 4B are diagrams illustrating an outline of registration displacement control during image transfer.

Normally, as illustrated in FIG. 4A, after a front end of sheet S entering the secondary transfer nip, conveyance speeds of the secondary transfer nip and the registration nip are controlled by control unit 100 so that loop L is formed in sheet S in a loop forming space between the secondary transfer nip and the registration nip. Upon registration roller pair 53*a* being displaced in this state, vibration of registration roller pair 53*a* caused by the displacement is transmitted to a part of sheet S, the part being sandwiched by registration roller pair 53*a*. Here, such vibration is absorbed by loop L formed in sheet S and thus is not transmitted to a part of sheet S, the part being downstream of loop L, any longer. Therefore, if loop L is normally formed in sheet S, vibration during displacement of registration roller pair 53*a* is not transmitted to the secondary transfer nip downstream of registration roller pair 53*a*.

Figure 4B:
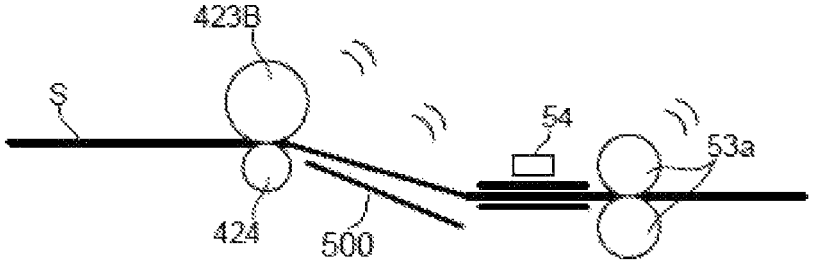

However, depending on the displacement speed of registration roller pair 53*a*, a shape of loop L of sheet S may be distorted, and as illustrated in FIG. 4B, loop L may be partly or entirely removed, and consequently, the part of sheet S in which loop L has been removed may be tensed. In this case, vibration during displacement of registration roller pair 53*a* is easily transmitted to the downstream secondary transfer nip via the part of sheet S in which loop L (slack) has been removed. Therefore, the present inventors learned that an image defect (transfer deviation) is more likely to occur in a toner image transferred to sheet S at the secondary transfer nip when vibration caused by displacement is transmitted to the secondary transfer nip.

Then, as a result of further tests, the present inventors found that in registration displacement control during image transfer, vibration caused by registration displacement can be prevented from being transmitted to the secondary transfer nip by setting the displacement speed of registration roller pair 53*a* to be lower than a conventional displacement speed, that is, a displacement speed before image transfer.

In other words, in the present embodiment, registration displacement during image transfer is performed at a displacement speed that is lower than that before the image transfer, preventing distortion of the shape of loop L of sheet S between the secondary transfer nip and the registration nip and thus preventing transfer deviation (image defect) due to transmission of vibration of registration roller pair 53*a*.

Figure 5:
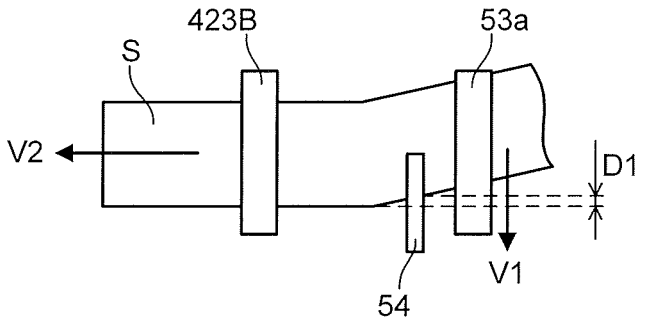
FIG. 5 is a diagram illustrating registration displacement control in the image forming apparatus according to Embodiment 1.

The content of registration displacement control in the present embodiment will be described in detail below with reference to FIG. 5.

In the present embodiment, during a toner image being transferred onto sheet S, control unit 100 limits a speed of displacement of registration roller pair 53*a* to a speed that causes no transfer deviation of the toner image by the secondary transfer nip. In other words, during transfer of a toner image, control unit 100 performs control to displace registration roller pair 53*a* at a displacement speed that causes no transfer deviation of the toner image relative to sheet S.

An example of registration displacement control to prevent an image defect such as transfer deviation will be described below.

Here, as described above, a displacement speed that causes transfer deviation is a displacement speed that causes removal of loop L of sheet S between the registration nip and the secondary transfer nip, in other words, a speed that causes no transfer deviation is a speed that is so low as to prevent removal of loop L. Then, a critical value (threshold value) of such displacement speed is a value that varies depending on an image forming condition such as a sheet type.

However, in order to prevent removal of loop L of sheet S regardless of the type of sheet S, the displacement speed of registration roller pair 53*a* may be set to be at least lower than the sheet conveyance speed in the secondary transfer nip (transfer section). In other words, as illustrated in FIG. 5, where V1 is the displacement speed of registration roller pair 53*a* and V2 is the sheet conveyance speeds of the secondary transfer nip, during transfer of a toner image, control unit 100 sets displacement speed V1 of registration roller pair 53*a* during image transfer as indicated in Expression 1 below:

$$V1<V2 \quad \text{(Expression 1).}$$

Therefore, during transfer of a toner image, control unit 100 controls the drive source (e.g., a stepping motor) for displacement of registration roller pair 53*a* so that displacement speed V1 of registration roller pair 53*a* is lower than sheet conveyance speed V2 of the secondary transfer nip.

In order to maintain loop L of sheet S to the highest possible extent, it is preferable to set the displacement speed of registration roller pair 53*a* to be as low as possible. From this perspective, control unit 100 causes the stepping motor that transmits a drive force for displacement to registration roller pair 53*a*, to operate at a frequency that is around a self-excitation frequency, whereby the displacement speed of registration roller pair 53*a* becomes lowest.

However, even where the speed is set as above, if the displacement speed is lower than a speed of movement (deviation speed) of sheet S in the sub scanning direction, deviation in the sub scanning direction of sheet S is accumulated, resulting in failure to correct sub scanning obliqueness. Therefore, during transfer of a toner image, control unit 100 causes registration roller pair 53*a* to be displaced at a displacement speed that is higher than a speed of deviation of a side edge of sheet S in the sub scanning direction (width direction).

Generally, where V3 is a deviation speed of sheet S, in order to achieve both prevention of transfer deviation and correction of sub scanning obliqueness, control unit 100 sets displacement speed V1 of registration roller pair 53*a* during image transfer as indicated in Expression 2 below:

$$V2>V1>V3 \quad \text{(Expression 2).}$$

Here, displacement speed V1 of registration roller pair 53*a* can be calculated according to a displacement amount per unit time (see displacement amount D in FIG. 5) or Expression 3 below:

$$\text{displacement speed } V1=\text{displacement amount/displacement time length} \quad \text{(Expression 3).}$$

A manner of displacement of registration roller pair 53*a* is not specifically limited, and registration roller pair 53*a* may be displaced continuously (that is, at a constant speed) or in multiple stages (intermittently). Here, even where a value of V1 in Expression 3 above is the same, if registration roller pair 53*a* is displaced in multiple steps, a displacement per step is performed at a speed that is higher than that of a case where registration roller pair 53 is displaced at a constant speed; however, each displacement may be performed at a speed that causes no distortion of a shape of loop L of sheet S.

Also, from the perspective of enhancement in printing productivity in recent years, it is desirable to set the displacement speed of registration roller pair 53*a* to be as high as possible.

In view of such circumstances, in the present embodiment, in a reset of displacement, a speed of operation of registration roller pair 53*a* returning to an initial position (home position) (that is, a returning operation of registration roller pair 53 moving in the width direction) is set to be higher than displacement speed V1. In other words, control unit 100 performs control so that upon a rear end in the conveyance direction of sheet S passing through the registration nip, registration roller pair 53*a* returns to the home position at a speed that is higher than displacement speed V1 before entry of next sheet S to the registration nip.

Also, where registration roller pair 53*a* is displaced a plurality of times for one sheet S, values of a deviation amount and deviation speed V3 of sheet S may vary depending on the timing of displacement, that is, the position in the conveyance direction of sheet S sandwiched by registration roller pair 53*a*. Therefore, where registration roller pair 53*a* is displaced a plurality of times for one sheet S, displacement speed V1 may be made to be variable for each time according to a deviation speed V3 of sheet S. In this case, control unit 100 sets the displacement speed of registration roller pair 53*a* during transfer of a toner image, for each displacement.

For example, in general, on the rear end side in the conveyance direction of a long sheet, the displacement amount of registration roller pair 53*a* needs to be increased and deviation speed V3 tends to be higher. In such case, control unit 100 controls displacement of registration roller pair 53*a* so that the displacement speed is lower and the displacement amount is larger on the more downstream side in the conveyance direction of sheet S.

Also, as described above, displacement speed V1 that causes no transfer deviation varies depending on the sheet type. Here, main factors of the type of sheet S include a basis weight (rigidity) of sheet S. In other words, normally, as the basis weight (rigidity) of sheet S is smaller, vibration of registration roller pair 53*a* is less likely to be transmitted to the secondary transfer nip, and thus displacement speed V1 can be set to be high. Also, in the case of sheet S having a very small rigidity such as a thin sheet, displacement speed V1 can be set to be higher than sheet conveyance speed V2 of the secondary transfer nip, which has been indicated in Expression 1 above.

Therefore, a table in which a value of the displacement speed of registration roller pair 53*a* during image transfer is registered (hereinafter referred to as "displacement speed table") may be provided for each of the sheet types mentioned above. Also, if there are a variety of sheet feed trays to be used (e.g., sheet feed tray units 51*a* to 51*c* and a sheet feed tray of a sheet feeding apparatus), there is a variety of sheet types, and thus, a displacement speed table may be provided for each sheet feed tray. In this case, at the time of execution of a print job, control unit 100 identifies a sheet type or a sheet feed tray from, e.g., a user setting screen and causes registration roller pair 53*a* to be displaced at a displacement speed registered in the corresponding displacement speed table.

Displacement speed V1 that causes no transfer deviation may also vary depending on an environment in which the apparatus is installed, in particular, an ambient hygrothermal environment of image forming apparatus 1. For example, in an HH environment in which a temperature and a humidity are high, an apparent rigidity of sheet S is low (sheet S is soft), enabling setting displacement speed V1 to be high, in comparison with an NN environment and an LL environment.

Therefore, a displacement speed table may be provided corresponding to a temperature and a humidity around image forming apparatus 1. In this case, at the time of execution of a print job, control unit 100 identifies ambient temperature and humidity from an output value from an internal thermo-hygro sensor (not illustrated) in the apparatus, and causes registration roller pair 53*a* to be displaced at a displacement speed in the corresponding displacement speed table.

Also, displacement speed V1 that causes no transfer deviation may also vary depending on a front side (first side) or a back side (second side) of sheet S at the time of double-sided printing. For example, an apparent rigidity of sheet S having a temperature already increased through a process of forming an image on one side (first side) thereof is lower (sheet S is softer), enabling setting the displacement speed to be higher.

Therefore, a displacement speed table may be provided for each of front and back sides of sheet S. In this case, control unit 100 reads a value in a displacement speed table according to a front side or a back side of sheet S at a stage before entry of a front end in the conveyance direction of sheet S to the secondary transfer nip, and upon the front end of sheet S entering the secondary transfer nip, causes registration roller pair 53*a* to be displaced at the relevant displacement speed.

Also, the value of displacement speed V1 that causes no transfer deviation may vary depending on the displacement amount of registration roller pair 53*a*. In this case, control unit 100 performs control so as to change displacement speed V1 of registration roller pair 53*a* according to the displacement amount.

For example, if the displacement amount of registration roller pair 53*a* in one displacement operation has a certain degree of smallness, displacement speed V1 of registration roller pair 53*a* may be set to be higher than sheet conveyance speed V2 of the secondary transfer nip, which has been indicated in Expression 1 above. In this case, it is possible that: a threshold value for a displacement amount or a deviation amount of sheet S is set in advance; and in causing registration roller pair 53*a* to be displaced, control unit 100 determines whether or not the displacement amount exceeds the threshold value, and decreases displacement speed V1 of registration roller pair 53*a* only when control unit 100 determines that the displacement amount exceeds the threshold value.

Also, a displacement speed table with displacement speed V1 registered therein may be provided for each of steps according to displacement amounts of registration roller pair 53*a*. In this case, in causing registration roller pair 53*a* to be displaced, control unit 100 identifies the relevant displacement amount and causes registration roller pair 53*a* at displacement speed V1 in the corresponding displacement speed table.

Furthermore, a configuration that enables, e.g., a user or a customer engineer (CE) to arbitrarily select or set displacement speed V1 during transfer of a toner image onto sheet S, via, e.g., a non-illustrated user setting screen (that is, a configuration including a user setting section) may be employed. For example, in execution of a print job, a configuration that enables a value of displacement speed V1 to be selected so as to be a value according to Expression 1 or enables a value registered in the above-described displacement speed table to be arbitrarily be modified.

Figure 6:
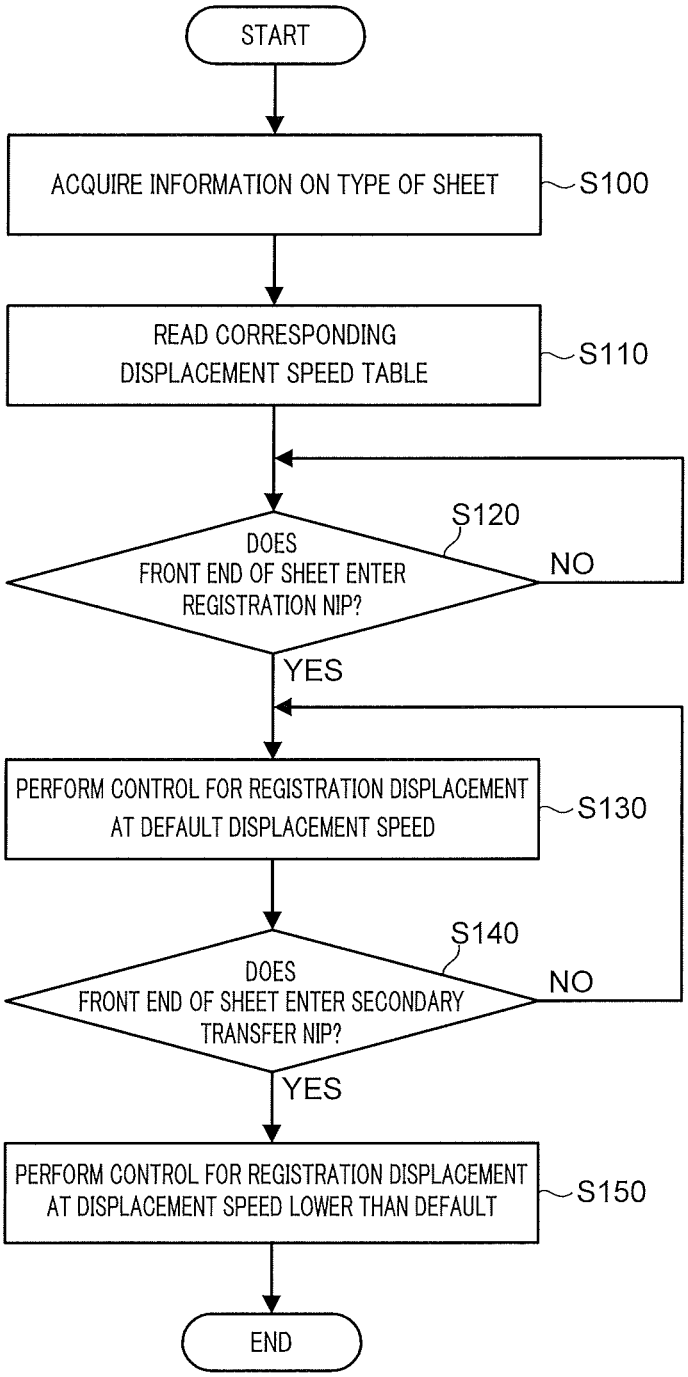
FIG. 6 is a flowchart illustrating an example of registration displacement control in Embodiment 1.
Figure 7:
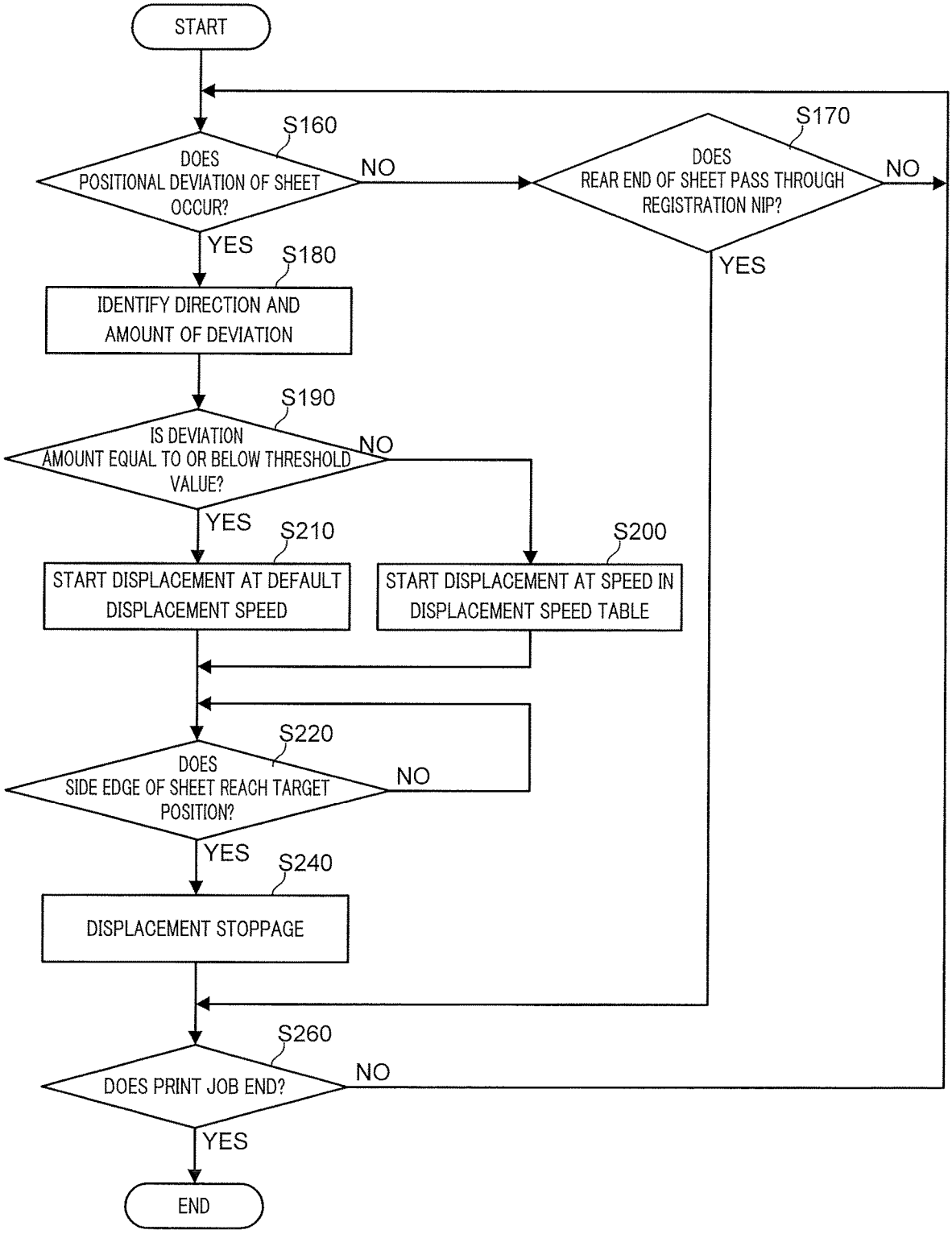
FIG. 7 is a flowchart illustrating an example of registration displacement control in Embodiment 1.

An example of operation for displacement control of registration roller pair 53*a*, thus, sheet S in image forming apparatus 1 will be described below with reference to the flowcharts in FIGS. 6 and 7. In the below example, control unit 100 controls displacement of registration roller pair 53*a* using a displacement speed table in which a value of a displacement speed after entry of sheet S to the secondary transfer nip is specified.

At the time of execution of a print job, control unit 100 acquires information on a type (in this example, a basis weight (rigidity)) of sheet S to be printed, from user setting information for the print job (step S100).

In step S110, control unit 100 reads a value in a displacement speed table corresponding to the acquired type (that is, the basis weight (rigidity)) of sheet S and sets the value in, e.g., a memory in advance to a displacement operation.

In step S120, control unit 100 determines whether or not a front end in the conveyance direction of sheet S enters the registration nip. Here, if control unit 100 determines that the front end of sheet S does not yet enter the registration nip (NO in step S120), control unit 100 returns to step S120 and repeats the determination. On the other hand, if control unit 100 determines that the front end of sheet S enters the registration nip (YES in step S120), control unit 100 activates line sensor 54 to detect a position of a side edge of sheet S and starts control for registration displacement at a default displacement speed (step S130).

Subsequently, control unit 100 determines whether or not the front end in the conveyance direction of sheet S enters the secondary transfer nip (step S140). Here, as long as control unit 100 determines that the front end in the conveyance direction of sheet S does not enter the secondary transfer nip (NO in step S140), control unit 100 returns to step S130 and continues the above-described control for displacement at the displacement speed of the default value. Therefore, in the example control, registration displacement before image transfer can be performed a plurality of times for one sheet S, and at this stage, the displacement speed of registration roller pair 53*a* is not limited.

On the other hand, if control unit 100 determines that the front end in the conveyance direction of sheet S enters the secondary transfer nip (YES in step S140), control unit 100 transitions to step S150. In step S150, control unit 100 performs control for registration displacement using the value set in step S110, that is, a displacement speed that is lower than the default (displacement speed V1 described above). In other words, upon entry of sheet S to the secondary transfer nip, control unit 100 regards sheet S as being subjected to image transfer and transitions to a mode in which a limit is imposed on the displacement speed.

A specific example of registration displacement control after sheet S entering the secondary transfer nip will be described below with reference to the flowchart in FIG. 7. Control unit 100 activates line sensor 54 again at a timing after entry of the front end in the conveyance direction of sheet S to the secondary transfer nip to detect the position of the side edge of sheet S, and determines whether or not positional deviation of sheet S occurs (step S160).

If control unit 100 determines that no positional deviation of the side edge of sheet S occurs (NO in step S160), control unit 100 determines whether or not a rear end in the conveyance direction of sheet S passes through the registration nip formed by registration roller pair 53*a* (step S170). Here, as long as the rear end of sheet S does not pass through the registration nip (NO in step S170), control unit 100 repeats determination of whether or not positional deviation of sheet S occurs (NO in step S160, and step S170). Then, if control unit 100 determines that positional deviation of sheet S occurs (YES in step S160), control unit 100 proceeds to step S180.

In step S180, control unit 100 identifies a direction and an amount of the deviation of the side edge of sheet S based on an output signal from line sensor 54. In subsequent step S190, control unit 100 determines whether or not the identified amount of the deviation of sheet S exceeds the aforementioned deviation amount threshold value (step S190).

Here, if control unit 100 determines that the amount of the deviation exceeds the threshold value (NO in step S190), control unit 100 regards vibration caused by displacement as being likely to be transmitted, and performs control to start displacement of registration roller pair 53*a* at a displacement speed that is lower than the default (step S200). In this example, control unit 100 outputs a control signal to the stepping motor for registration roller pair 53*a* so as to start displacement at the speed specified in a displacement speed table read in step S110.

On the other hand, if control unit 100 determines that the amount of the deviation is equal to or below the threshold value (YES in step S190), control unit 100 regards no vibration caused by displacement as being transmitted, and starts displacement of registration roller pair 53*a* at the default speed (step S210).

After the start of displacement in step S200 or step S210, control unit 100 determines whether or not the side edge of sheet S reaches the target position based on an output signal from line sensor 54 (step S220). Control unit 100 continues the displacement at the displacement speed until control unit 100 determined that the side edge of sheet S reaches the target position (NO in step S220), and if control unit 100 determines that the side edge of sheet S reaches the target position (YES in step S220), control unit 100 proceeds to step S240.

In step S240, control unit 100 outputs a control signal to the stepping motor for registration roller pair 53*a* so as to stop the displacement of registration roller pair 53*a*.

The above control enables preventing an image defect caused by vibration during displacement of registration roller pair 53*a* and correcting sub scanning obliqueness of sheet S during transfer of a toner image.

Also, even where positional deviation of sheet S occurs during transfer of a toner image, if an amount of the deviation is small, printing productivity can be enhanced by exceptionally performing registration displacement at the default displacement speed.

Also, in this control example, a side edge of sheet S can correctly be aligned with a desired position by performing control for stopping displacement of registration roller pair 53*a* based on a result of detection of the side edge of sheet S by line sensor 54.

In step S260, control unit 100 determines whether or not the print job ends. As a result of the determination, if the print job does not end (NO in step S260), control unit 100 returns to step S160 and continues determination of whether or not positional deviation of sheet S occurs until the rear end of sheet S passes through the registration nip (NO in step S170, and step S160). Therefore, in this control example, registration displacement during image transfer is performed a plurality of times for one sheet S.

Also, if control unit 100 determines that the rear end of sheet S passes through the registration nip (YES in step S170), control unit 100 proceeds to step S260, and if there is next sheet S to be printed, control unit 100 regards the print job as not ending (NO in step S260) and returns the processing to step S160. Therefore, in this example control, registration displacement can be performed under a same setting condition while printing of a toner image on each of a plurality of sheets S being performed.

Then, if control unit 100 determines that the print job ends (YES in step S260), control unit 100 ends the above-described series of processing.

As described above, the present embodiment enables correcting sub scanning obliqueness during image transfer while preventing an image defect caused by transmission of vibration during displacement to the transfer section.

Alterations will be described below. As described above, from the perspective of enhancement of printing productivity, it is desirable to set displacement speed V1 registered in a displacement speed table or the like to be as high as possible; however, in such case, an increase in risk of transfer deviation due to, e.g., an error can be expected.

In view of such problem, for example, a configuration in which a known image scanner (image reading apparatus) is disposed downstream of the secondary transfer nip to read a toner image formed on sheet S via the image scanner and feeds a result of the reading back to displacement speed V1 may be employed. In this case, control unit 100 determines whether or not transfer deviation actually occurs, based on the result of the reading by the image scanner, and if control unit 100 determines that transfer deviation occurs, control unit 100 regards displacement speed V1 as being high, and modifies displacement speed V1 in the corresponding displacement speed table to a value that is lower than displacement speed V1.

As another example configuration, a loop amount of loop L in sheet S that is being conveyed may be detected in real time by a loop detection sensor (loop detection section) 500 and control unit 100 may change displacement speed V1 according to a result of the detection.

As a specific example of the loop detection sensor 500, a known actuator that comes into contact with sheet S, an angle of the actuator changing according to a shape of loop L of sheet S, is provided in the loop forming space (see FIG. 4A) between the secondary transfer nip and the registration nip. This loop detection section 500 outputs a signal according to the angle (degree of tiling) of the actuator to control unit 100.

One such actuator is disposed, for example, at a center in the width direction of sheet S. In this case, control unit 100 identifies an entire loop amount in the width direction of sheet S according to the angle of the actuator, and if the loop amount is small, regards an image defect as being likely to occur, and modifies displacement speed V1 in the corresponding displacement speed table to a value that is lower than displacement speed V1.

In another example, two actuators are disposed in total on opposite sides in the width direction of sheet S. In this case, control unit 100 determines whether or not a shape of loop L of sheet S has a distortion, from angles of the respective actuators, and if control unit 100 determines that the shape has a distortion, control unit 100 regards an image defect as being likely to occur and modifies displacement speed V1 in the corresponding displacement speed table to a value that is lower than displacement speed V1.

The above example configuration has been described in terms of a case where control unit 100 identifies a direction and an amount of positional deviation of a side edge of sheet S using line sensor 54 and starts displacement of registration roller pair 53*a*. However, where a direction and an amount of positional deviation of a side edge of sheet S are known in advance (can be estimated) because of, e.g., an idiosyncrasy particular to the apparatus, in step S160, control unit 100 may start displacement of registration roller pair 53*a* without using a result of detection by line sensor 54. In this case, a timing or a position on sheet S (displacement point) for starting displacement of registration roller pair 53*a*, a displacement direction and a displacement amount are specified in advance as fixed values (preset values). Then, control unit 100 reads the respective values specified as the preset values out onto, e.g., a memory, for example, prior to the start of displacement in step S160, and then performs the processing in step S160 onwards according to the set values.

Also, even after sheet S entering the secondary transfer nip (transfer section), during a toner image being not secondary-transferred onto sheet S (for example, during a margin area of a sheet passing through the secondary transfer nip), there is no fear of transfer deviation and thus there may be no need to decrease the displacement speed of registration roller pair 53*a*. Therefore, even after sheet S entering the secondary transfer nip (transfer section), control unit 100 may cause registration roller pair 53*a* to be displaced, for example, at the default value as long as a toner image is not secondarily transferred onto sheet S.

Embodiment 2

Figure 8:
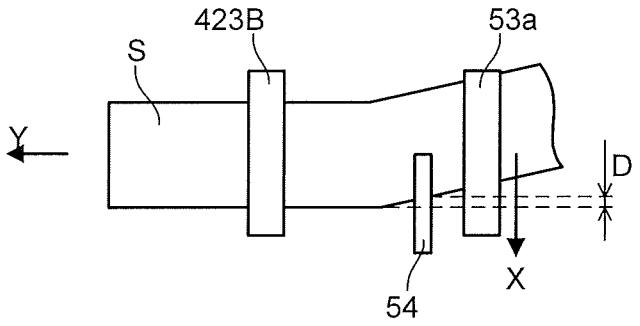
FIG. 8 is a diagram illustrating registration displacement control in an image forming apparatus according to Embodiment 2.
Figure 9:
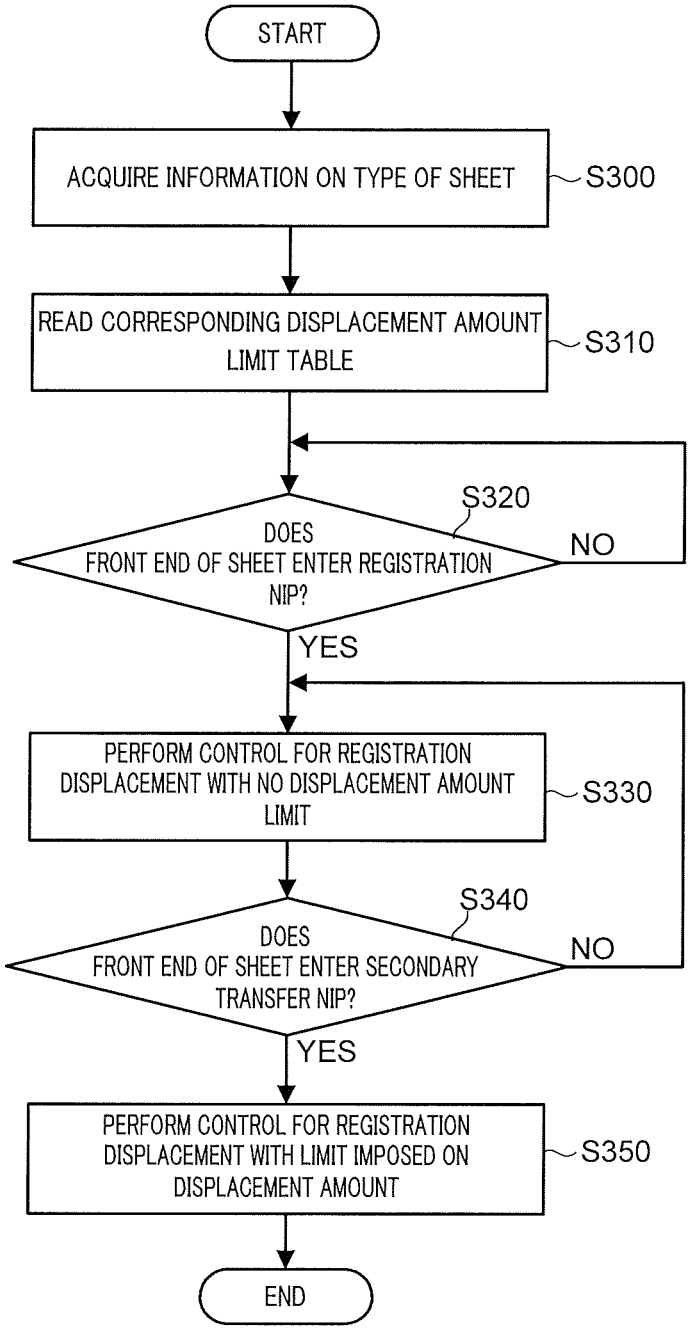
FIG. 9 is a flowchart illustrating an example of registration displacement control in Embodiment 2.
Figure 10:
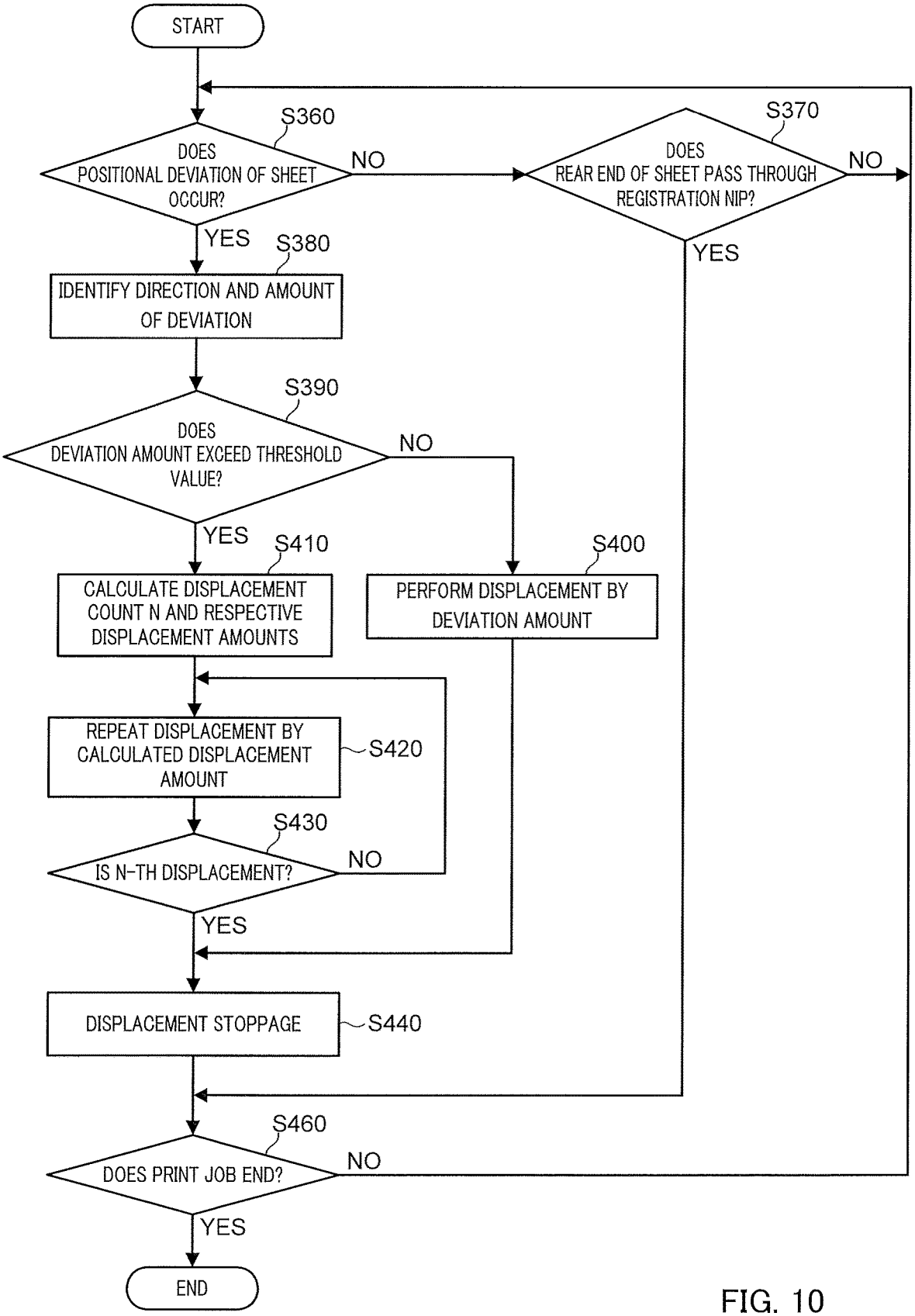
FIG. 10 a flowchart illustrating an example of registration displacement control in Embodiment 2.

Next, an image forming apparatus according to Embodiment 2 will be described mainly with reference to FIGS. 8 to 10. An overall configuration of the image forming apparatus and a major part of a control system in Embodiment 2 are the same as those of Embodiment 1 described above (see FIGS. 1 and 2), and thus, illustration and description thereof will be omitted.

In view of the conventional problems stated with reference to, e.g., FIGS. 3 and 4, the present inventors conducted further tests relating to displacement of registration roller pair 53*a* during image transfer. As a result, the present inventors found that in control for registration displacement during image transfer, vibration caused by registration displacement can be prevented from being transmitted to a secondary transfer nip by imposing a limit on a displacement amount of registration roller pair 53*a*.

In other words, in Embodiment 2, control for causing registration roller pair 53*a* to perform one displacement operation for sheet S during transfer of a toner image by a secondary transfer nip, with a displacement amount that is equal to or below a predetermined displacement amount threshold value, so as to cause no transfer deviation of the image. Such registration displacement control enables preventing distortion of a shape of loop L in sheet S between a secondary transfer nip and a registration nip and thus preventing transfer deviation (image defect) accompanying transmission of vibration of registration roller pair 53*a*.

The content of the registration displacement control in Embodiment 2 will be described in detail below with reference to FIG. 8.

In Embodiment 2, during transfer of a toner image onto sheet S, a displacement amount of registration roller pair 53*a* is limited to a displacement amount that is equal to or below a displacement amount threshold value that causes no transfer deviation of the toner image by a secondary transfer nip. Such limitation of the displacement amount may be provided if an amount of deviation of sheet S exceeds a displacement amount threshold value.

In a specific example, control unit 100 performs control so as to if deviation of sheet S, an amount of the deviation exceeding the displacement amount threshold value, occurs during transfer of a toner image, displace registration roller pair 53*a* a plurality of times with a displacement amount that is equal to or below the aforementioned displacement amount threshold value, according to the amount of the deviation of sheet S.

At this time, control unit 100 increases the count of displacements to N according to Expression 1 below:

$$N > \text{amount of deviation of sheet from target position} / \text{displacement amount threshold value} \quad \text{(Expression 1)}$$

For example, where the displacement amount threshold value is 1 mm and the amount of deviation of sheet S from the target position (see deviation amount D in FIG. 5) is 2 mm, if registration roller pair 53*a* is displaced by 2 mm according to the amount of deviation of sheet S in one displacement operation, transfer deviation is highly likely to occur in a toner image on sheet S. Also, if control to displace registration roller pair 53*a* by 1 mm, which is the displacement amount threshold value, in one displacement operation, transfer deviation is still likely to occur in a toner image on sheet S because an actual displacement amount of registration roller pair 53*a* may slightly vary depending on, e.g., the state of the apparatus and/or an error.

Therefore, in such case, control unit 100 performs control to increase the count (N) of displacements of registration roller pair 53*a* to three according to Expression 1 above to, for example, displace registration roller pair 53*a* by 0.7 mm in the first displacement operation, 0.7 mm in the second displacement operation and 0.6 mm in the third displacement operation.

As described above, control unit 100 controls displacement of registration roller pair 53*a* so as to, in a manner, divide one displacement operation to increase the count of displacements to N and repeat a displacement operation with a small displacement amount until a total of displacement amounts of the N displacements reaches a value corresponding to the amount of deviation of sheet S from the target position. Such control enables eliminating positional deviation of sheet S while preventing an image defect due to, e.g., transfer deviation by reducing a displacement amount in each displacement operation of registration roller pair 53*a*.

With regard to the displacement amount threshold value, as described above, a displacement amount that causes transfer deviation in one displacement operation is a displacement amount that causes removal of a slack, that is, loop L of sheet S between the registration nip and the secondary transfer nip. In other words, a displacement amount that causes no transfer deviation in one displacement operation is a displacement amount that causes no removal of loop L. Then, a critical value for whether or not transfer deviation occurs, that is, a displacement amount threshold value is a value that varies depending on an image forming condition such as a sheet type as below.

The displacement amount threshold value is a value that varies depending on a sheet type. Here, main factors of the type of sheet S include a basis weight (rigidity) of sheet S. More specifically, normally, as the basis weight (rigidity) of sheet S is smaller, vibration of registration roller pair 53*a* is less likely to be transmitted to the secondary transfer nip, and thus, the displacement amount threshold value can be set to be high.

Therefore, a table in which a displacement amount threshold value for registration roller pair 53*a* during image transfer is registered (hereinafter referred to as "displacement amount limit table") may be provided for each of the above sheet types. Also, if there is a variety of sheet feed trays (e.g., sheet feed tray units 51*a* to 51*c* and a sheet feed tray of a sheet feeding apparatus), there is a variety of sheet types, and thus, a displacement amount limit table may be provided for each sheet feed tray.

In this case, at the time of execution of a print job, control unit 100 identifies a sheet type or a sheet feed tray from, e.g., a user setting screen and sets the displacement amount threshold value registered in the corresponding displacement amount limit table, in, e.g., a memory. Then, control unit 100 limits a displacement amount for one displacement of registration roller pair 53*a* during image transfer to a value that is equal to or below the set displacement amount threshold value.

Also, the displacement amount threshold value may vary depending on a front side (first side) or a back side (second side) of sheet S at the time of double-sided printing. For example, an apparent rigidity of sheet S having a temperature already increased through a process of forming an image on one side (first side) is lower (sheet S is softer), enabling setting the displacement amount for one displacement to be larger.

Therefore, a displacement amount limit table may be provided for each of a front side and a back side of sheet S. In this case, control unit 100 reads a displacement amount threshold value in a displacement amount limiting table according to a front side or back side of sheet S at a stage before entry of a front end in a conveyance direction of sheet S to the secondary transfer nip, and after entry of the front end of sheet S to the secondary transfer nip, limits a displacement amount for one displacement of registration roller pair 53*a* to a value that is equal to or below the set displacement amount threshold value.

The displacement amount threshold value may also vary depending on an environment in which the apparatus is installed, in particular, an ambient hygrothermal environment of image forming apparatus 1. For example, in an HH environment in which a temperature and a humidity are high, an apparent rigidity of sheet S is low (sheet S is soft), enabling setting the displacement amount for one displacement to be higher.

Therefore, a displacement amount limit table may be provided corresponding to a temperature and a humidity around image forming apparatus 1. In this case, at the time of execution of a print job, control unit 100 identifies ambient temperature and humidity from an output value from an internal thermo-hygro sensor (not illustrated) in the apparatus and reads a displacement amount threshold value in the corresponding displacement amount limit table, and after entry of a front end of sheet S to the secondary transfer nip, limits a displacement amount for one displacement of registration roller pair 53*a* to a value that is equal to or below the set displacement amount threshold value.

An example of operation for displacement control of registration roller pair 53*a*, thus, sheet S in image forming apparatus 1 after sheet S entering the secondary transfer nip will be described below with reference to the flowcharts in FIGS. 9 and 10. In the below example, control unit 100 controls displacement of registration roller pair 53*a* using a displacement amount limit table in which an upper limit for a displacement amount for one displacement (displacement amount threshold value) after sheet S entering the secondary transfer nip is specified.

At the time of execution of a print job, control unit 100 acquires information on a type (in this example, a basis weight (rigidity)) of sheet S to be printed, from user setting information for the print job (step S300).

In step S310, control unit 100 reads a displacement amount threshold value registered in a displacement amount limit table corresponding to the type (that is, the basis weight (rigidity)) of sheet S and sets the value in, e.g., the memory in advance to displacement operation.

In step S320, control unit 100 determines whether or not a front end in the conveyance direction of sheet S enters the registration nip. Here, if control unit 100 determines that the front end of sheet S does not yet enter the registration nip (NO in step S320), control unit 100 returns to step S320 and repeats the determination. On the other hand, if control unit 100 determines that the front end in the conveyance direction of sheet S enters the registration nip (YES in step S320), control unit 100 activates line sensor 54 to detect a position of a side edge of sheet S and starts control for registration displacement with no displacement amount limit (step S330).

Subsequently, control unit 100 determines whether or not the front end in the conveyance direction of sheet S enters the secondary transfer nip (step S340). Here, as long as control unit 100 determines that the front end in the conveyance direction of sheet S does not enter the secondary transfer nip (NO in step S340), control unit 100 returns to step S330 and continues the above-described displacement control with no displacement amount limit. Therefore, at this stage, control unit 100 performs control so as to displace registration roller pair 53*a* with a displacement amount that is equal to the amount of deviation of sheet S identified through line sensor 54. Also, in this example control, registration displacement before image transfer can be performed a plurality of times for one sheet S.

On the other hand, if control unit 100 determines that the front end in the conveyance direction of sheet S enters the secondary transfer nip (YES in step S340), control unit 100 proceeds to step S350. In step S350, control unit 100 performs registration displacement control in which a displacement amount for one displacement operation is limited to a value that is equal to or below the displacement amount threshold value set in step S310. In other words, upon sheet S entering the secondary transfer nip, control unit 100 regards sheet S as being subjected to image transfer and transitions to a mode in which a limit is imposed on a displacement amount for one displacement operation.

A specific example of registration displacement control after sheet S entering the secondary transfer nip will be described with reference to the flowchart in FIG. 10. Control unit 100 activates line sensor 54 again at a timing after entry of the front end in the conveyance direction of sheet S to the secondary transfer nip to detect the position of the side edge of sheet S, and determines whether or not positional deviation of sheet S occurs (step S360).

If control unit 100 determines that no positional deviation of the side edge of sheet S occurs (NO in step S360), control unit determines whether or not a rear end in the conveyance direction of sheet S passes through the registration nip formed by registration roller pair 53*a* (step S370). Here, as long as the rear end of sheet S does not pass through the registration nip (NO in step S370), control unit 100 repeats determination of whether or not positional deviation of sheet S occurs (NO in step S360, and step S370), and if control unit 100 determines that positional deviation of sheet S occurs (YES in step S360), control unit 100 proceeds to step S380.

In step S380, control unit 100 identifies a direction and an amount of the deviation of the side edge of sheet S based on an output signal from line sensor 54. In subsequent step S390, control unit 100 determines whether or not the identified amount of the deviation of sheet S exceeds the set displacement amount threshold value (step S390).

Here, if control unit 100 determines that the deviation amount does not exceed the displacement amount threshold value, that is, is equal to or below the displacement amount threshold value (NO in step S390), control unit 100 causes registration roller pair 53*a* to be displaced by an amount corresponding to the deviation amount (step S400) and then stops the displacement (step S440). In other words, in this case, control unit 100 regards no transfer deviation as being likely to occur, and controls displacement of registration roller pair 53*a* so as to correct the detected positional deviation of sheet S with one displacement operation.

On the other hand, if control unit 100 determines that the amount of the deviation of sheet S exceeds the displacement amount threshold value (YES in step S390), control unit 100 regards transfer deviation as being likely to occur, and proceeds to step S410 in order to increase the count of displacements.

In step S410, control unit 100 calculates the displacement count N according to Expression 1 indicated above. Also, control unit 100 calculates a displacement amount for one displacement by dividing the amount of the deviation of sheet S by the displacement count N.

Subsequently, control unit 100 causes registration roller pair 53*a* to be repeatedly displaced in a direction in which the positional deviation of sheet S is corrected, by the calculated displacement amount (step S420) and determines whether or not the current displacement is the N-th displacement (step S430). If control unit 100 determines that the current displacement is not yet the N-th displacement (NO in step S430), control unit 100 continues the displacement in step S420. On the other hand, if control unit 100 determines that the current displacement is the N-th displacement (YES in step S430), control unit 100 performs control so as to stop registration roller pair 53*a* with the relevant displacement amount (step S440).

In step S460 after the stoppage of the displacement of registration roller pair 53*a*, control unit 100 determines whether or not the print job ends. As a result of the determination, if the print job does not end (NO in step S460), control unit 100 returns to step S360 and continues the determination of whether or not positional deviation of sheet S occurs until the rear end of sheet S passes through the registration nip (NO in step S370, and step S360).

Also, if control unit 100 determines that the rear end of sheet S passes through the registration nip (YES in step S370), control unit 100 proceeds to step S460, and if there is next sheet S to be printed, control unit 100 regards the print job as not ending (NO in step S460) and returns the processing to step S360. Therefore, in this example, registration displacement can be performed under a same setting condition while printing of a toner image on each of a plurality of sheets S.

Then, if control unit 100 determines that the print job ends (YES in step S460), control unit 100 ends the above-described series of processing.

Such control as above enables correcting sub scanning obliqueness of sheet S during toner image transfer while preventing an image defect caused by vibration during displacement of registration roller pair 53*a*.

Also, where an amount of positional deviation of sheet S during toner image transfer is at or below a displacement amount threshold value, control to displace registration roller pair 53*a* by an amount corresponding to the displacement amount without increasing the count of displacements, enabling enhancement of printing productivity.

The above example configuration has been described in terms of a case where control unit 100 identifies a direction and an amount of positional deviation of a side edge of sheet S using line sensor 54 and starts displacement of registration roller pair 53*a*.

However, where a direction of positional deviation of a side edge of sheet S or a displacement amount is known in advance because of, e.g., an idiosyncrasy particular to the apparatus, control unit 100 may cause registration roller pair

53*a* to be displaced, without using a result of detection by line sensor 54. In this case, a timing or a position on sheet S (displacement point) for starting displacement of registration roller pair 53*a*, a displacement direction and a displacement amount are specified in advance as fixed values (preset values). Then, control unit 100 reads the respective values specified as the preset values out onto, e.g., the memory and sets the respective values, prior to execution of a print job, and performs the following processing according the set values.

Prior to displacement operation of registration roller pair 53*a*, control unit 100 determines whether or not the displacement amount specified as a preset value exceeds the displacement amount threshold value (see step S390). If control unit 100 determines that the displacement amount specified as a preset value does not exceed the displacement amount threshold value, that is, is equal to or below the displacement amount threshold value (NO in step S390), control unit 100 causes registration roller pair 53*a* to be displaced by the displacement amount (step S400) and stops the displacement (step S440). On the other hand, if control unit 100 determines that the displacement amount specified as a preset value exceeds the displacement amount threshold value (YES in step S390), control unit 100 regards transfer deviation as being likely to occur and proceeds to step S410 in order to increase the count of displacements. Step S410 onwards is similar to those described above and thus description thereof will be omitted.

In the example control, control unit 100 performs, e.g., calculation of the displacement count N and processing for increasing the displacement count, immediately before displacement operation. As another example, it is possible that if an amount of positional deviation of sheet S conveyed previously exceeds a displacement amount threshold value, control unit 100 may make a setting for increasing the count of displacements for sheet S to be conveyed subsequently, in advance, that is, feed a result of preceding sheet S back to subsequent sheet S.

As a specific example such other example, e.g., a case where a direction of positional deviation of a side edge of sheet S is known in advance but a displacement amount is not known in advance (cannot be estimated) is conceivable. In this case, the above-described preset values may be used; however, for each displacement point, a displacement direction can be specified but a displacement amount cannot be specified. In such case, for example, first sheet S from a start of a print job is used as what is called a test sheet, and prior to displacement of registration roller pair 53*a* at each displacement point specified as a preset value, detection of deviation of a side edge of sheet S is performed by line sensor 54.

Here, for a deviation amount exceeding the displacement amount threshold value from among deviation amounts of the side edge of sheet S, which have been detected at the respective displacement points, control unit 100 calculates displacement count N so as to increase the displacement count at the relevant displacement point and applies a result of the calculation to printing for second sheet S onwards.

The above example configuration has been described in terms of a case where line sensor 54 is provided upstream of the secondary transfer nip in the sheet conveyance direction. As another example configuration, an additional line sensor that is similar to line sensor 54 may be provided downstream in the sheet conveyance direction of the secondary transfer nip for control unit 100 to identify a direction and an amount of positional deviation of sheet S based on output signals from the two line sensors (see step S380). In this case, an amount of deviation of sheet S after entry to the secondary transfer nip, thus, a displacement amount necessary for registration roller pair 53*a* can more accurately be identified.

Also, as another example configuration, loop amounts on opposite end sides (left and right sides or front and back sides) in a width direction of loop L in sheet S that is being conveyed may be detected in real time for control unit 100 to identify an amount of deviation of sheet S from a difference between the loop amount on the left (near) side and the loop amount on the right (back) side (see step S180). For example, in the example illustrated in FIG. 8, the downstream side in the conveyance direction of sheet S has obliqueness toward the right (back) side, and this obliqueness reduces a loop amount on the left (front) side of sheet S relative to that on the right (back) side. Therefore, a direction and an amount of deviation of sheet S can be identified from a difference between loop amounts on the opposite sides in the width direction of sheet S.

More specifically, a known actuator that comes into contact with sheet S, an angle of the actuator changing according to a shape of loop L of sheet S, is provided in a loop forming space (see FIG. 4A) between the secondary transfer nip and the registration nip to output a signal according to the angle (degree of tilting) of the actuator to control unit 100.

Two such actuators are disposed in total on opposite sides in the width direction of sheet S. In this case, control unit 100 identifies sub scanning obliqueness (see FIG. 8), that is, a direction and a degree of deviation on the downstream side, of sheet S from the angles of the respective actuators (see step S380).

The above example control has been described in terms of a case where registration roller pair 53*a* is displaced by a displacement amount according to an amount of deviation of sheet S and the displacement is stopped. As another example control, it is possible that control unit 100 does not stop displacement, that is, causes registration roller pair 53*a*, thus, sheet S to be consistently displaced without exceeding the displacement amount threshold value.

Also, even after sheet S entering the secondary transfer nip, as long as a toner image is not secondarily transferred onto sheet S (for example, during a margin area of a sheet passing through the secondary transfer nip), there is no fear of transfer deviation and thus there may be no need to limit a displacement amount of registration roller pair 53*a*. Therefore, even after sheet S entering the secondary transfer nip (transfer section), control unit 100 may cause registration roller pair 53*a* to be displaced by a displacement amount according to an amount of deviation of sheet S as long as a toner image is not secondarily transferred onto sheet S.

[Supplement] According to Embodiment 2 described above, the technical ideas and configurations stated in (1) to (12) below can be derived.

(1) Control unit 100 controls displacement of a sheet conveying member (registration roller pair 53*a*; the same applies to the below) to displace sheet S along a width direction of sheet S and thereby eliminate deviation of sheet S from a target position, and causes the sheet conveying member to be displaced by a displacement amount that is equal to or below a predetermined displacement amount threshold value in one displacement operation of sheet conveying member (53*a*) for sheet S during transfer of an image by a transfer section (421, 423B, 424), so as to prevent transfer deviation of the image.

(2) In the configuration in (1) above, control unit 100 controls the sheet conveying member (53*a*) so as to increase a count of displacements according to an amount of the deviation of sheet S from the target position.

(3) In the configuration in (2) above, if the amount of the deviation of sheet S exceeds the displacement amount threshold value, control unit 100 increases the count of displacements.

(4) In the configuration in (3) above, control unit 100 controls the sheet conveying member (53*a*) so as to repeat displacement until a total of the displacement amounts of the sheet conveying member (53*a*) reaches a value corresponding to the amount of the deviation of sheet S.

(5) In the configuration in (3) or (4) above, control unit 100 increases the count of displacements to N according to Expression 1 below:

$$N > \text{amount of deviation of sheet from target position} / \text{displacement amount threshold value} \quad \text{(Expression 1)}$$

(6) In the configuration in any of (1) to (5) above, before sheet S entering the transfer section (421, 423B, 424), control unit 100 causes the sheet conveying member (53*a*) to be displaced by a displacement amount corresponding to an amount of the deviation of sheet S in the one displacement operation.

(7) In the configuration in (3) above, if the amount of the deviation of sheet S conveyed previously exceeds the displacement amount threshold value, control unit 100 makes a setting for increasing the count of displacements for sheet S to be conveyed subsequently.

(8) In the configuration in any of (1) to (7) above, control unit 100 controls displacement of the sheet conveying member (53*a*) using a table in which the displacement amount threshold value is registered.

(9) In the configuration in (8) above, the table is provided corresponding to a type of sheet S.

(10) In the configuration in (8) or (9) above, the table is provided corresponding to a sheet feed tray (51*a* to 51*c*).

(11) In the configuration in any of (8) to (10) above, the table is provided for each of a front and a back of the sheet.

(12) In the configuration in any of (8) to (11) above, the table is provided corresponding to a temperature and a humidity around image forming apparatus 1.

Embodiment 3

An image forming apparatus according to Embodiment 3 will be described with reference to the drawings. An overall configuration of the image forming apparatus and a major part of a control system in Embodiment 3 are the same as those of Embodiment 1 described above, and thus, illustration and description thereof will be omitted.

In view of the aforementioned problems in conventional displacement control of registration roller pair 53*a*, the present inventors repeatedly conducted a test in which registration rollers are displaced a plurality of times for one sheet S before and after image transfer. As a result, it turned out that depending on, e.g., the state of sheet S or the apparatus, a mechanical restriction (maximum displacement amount) of registration roller pair 53*a* may be reached as a result of the plurality of displacements. In this case, if an attempt is made to continue the displacement control, the apparatus (e.g., a drive source for registration roller pair 53*a*) may be damaged. Also, after a maximum displacement amount being reached as a result of a plurality of displacement operations, if conveyance of sheet S, that is, printing processing is continued without registration rollers being displaced, an image defect may occur, and if sub scanning obliqueness is large, a jam may also occur. In addition, a print job for a plurality of sheets S, e.g., an image defect is likely to occur not only in current sheet S but also in subsequent sheets S, that is, a plurality of sheets S may be wasted.

Figure 11:
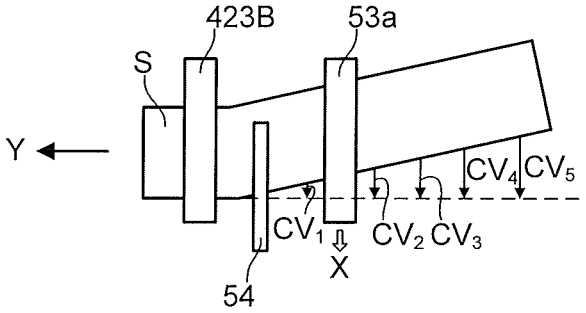
FIG. 11 is a diagram illustrating Embodiment 3, and is a diagram illustrating a displacement amount accumulation state where registration displacement is performed for a sheet in which sub scanning obliqueness occurs.

Such problem will be described in more detail with reference to FIG. 11. FIG. 11 illustrates a case where during formation of a toner image after sheet S (long sheet) entering a secondary transfer nip, sub scanning obliqueness of sheet S to the right side (back side of the apparatus) occurs intermittently.

In this case, it is necessary to displace registration roller pair 53*a* a plurality of times in the arrow X direction (in this example, to the left side, that is, the near side of the apparatus) so as to align a side edge of sheet S with a target position indicated by the dotted line in the figure. FIG. 11 illustrates a case where registration roller pair 53*a* is displaced five times to the left side (near side of the apparatus) until a rear end in a conveyance direction of sheet S passes through a registration nip formed by registration roller pair 53*a*. In the figure, a cumulative value of displacement amount (that is, a total amount of displacement to one side in the width direction) of registration roller pair 53*a* is indicated by arrow CV ($CV_1$ to $CV_5$).

In the illustrated example, it can be seen that cumulative value CV of displacement amount of registration roller pair 53*a* incrementally increases on the more rear end side of sheet S. In actual sheet conveyance, sub scanning obliqueness may occur both leftward and rightward (what is called meandering may occur), and in this case, cumulative value CV of displacement amounts increases and decreases along with conveyance of sheet S.

In any case, if a long sheet that is long in the conveyance direction is conveyed as sheet S, cumulative value CV of displacement amount tends to be large, and cumulative value CV may reach a limit value (mechanical/physical limit value, that is, "maximum displacement amount") for displacement of registration roller pair 53*a*.

Here, the maximum displacement amount will be described. Normally, before execution of a print job, registration roller pair 53*a* is in a home position (initial position), and there is a mechanical limit value of movement in leftward and rightward directions (to the front and back sides of the apparatus) in the width direction from the initial position. In other words, the maximum displacement amount is a maximum value (limit distance) of movement of registration roller pair 53*a* in the leftward and rightward directions (to the front and back sides of the apparatus) in the width direction from the initial position. In the below, for simplicity, unless otherwise noted, it is assumed that a maximum displacement amount in the leftward (front side) direction in the width direction from the initial position and a maximum displacement amount in the rightward (back side) direction from the initial position have a same value.

The case example in FIG. 11 will be described. For example, where it is assumed that a maximum displacement amount of registration roller pair 53*a* is reached with cumulative value $CV_4$ at the time of completion of the fourth displacement, the fifth displacement in a direction that is the same as that of the fourth displacement cannot be performed because of a mechanical restriction. Furthermore, if the maximum displacement amount is reached at some point during the fourth displacement (that is, cumulative value $CV_4$ exceeds the maximum displacement amount), it is necessary to stop the fourth displacement at that point.

Also, even if sheet S is not a long sheet, for example, in the case of occurrence of an irregular state, such as misalignment between the apparatuses when printing is performed with an optional sheet feeding apparatus (not illustrated) connected to image forming apparatus 1, misalignment between rollers or deformation of a guide plate, obliqueness of sheet S becomes large. Therefore, in this case, also, cumulative value CV for registration roller pair 53*a* massively increases and may exceed the maximum displacement amount of registration roller pair 53*a*.

As described above, as a result of the present inventors' diligent study, it turned out that depending on, e.g., the type of sheet S or the state of the apparatus, the maximum displacement amount of registration roller pair 53*a* may be reached as a result of a plurality of displacements of registration roller pair 53*a*.

As a countermeasure for such problem, a configuration with an increase in maximum displacement amount, that is, an increase in range (physical/mechanical limit value) of displacement of registration roller pair 53*a* is conceivable. In other words, conventionally, registration roller pair 53*a* is displaced only once and it is not contemplated that registration roller pair 53*a* is displaced several times, and therefore, conventional configurations can be considered as not securing a sufficient maximum displacement amount for registration roller pair 53*a*.

However, employment of such configuration leads to an increase in size and cost of image forming apparatus 1. Also, where a configuration with a maximum displacement amount simply increased is employed, depending on, e.g., the type of the sheet, contrarily, a jam may be more likely to occur or, e.g., an abnormality of the apparatus may fail to be found easily.

Therefore, in the present embodiment, a configuration in which control unit 100 is provided with a function as a determination section that determines whether or not cumulative value CV of displacement amount of registration roller pair 53*a* exceeds a threshold value and control unit 100 performs various types of control described below, according to a result of such determination. From another perspective, in the present embodiment, control unit 100 determines whether or not a position of registration roller pair 53*a* is moved beyond a position corresponding to the threshold value by displacement, and performs control according to a result of the determination.

Here, the threshold value is a value that can be set separately from the maximum displacement amount, and a value that is equal to or below the maximum displacement amount can arbitrarily be set by a user as the threshold value. In one example, a value close to the maximum displacement amount is set as a default value for the threshold value and the default value can be changed through a non-illustrated user setting screen. Here, the default value for the threshold value can be set to be a value that is slightly smaller than the maximum displacement amount in order to, for example, even if a slight error (e.g., delay) occurs during stoppage of displacement, prevent, e.g., a motor that transmits a motive force for displacement of registration roller pair 53*a* from being damaged.

Also, the threshold value is a value for control unit 100 to recognize occurrence of any sort of abnormality, and thus, if the threshold value is set to be a value that is excessively smaller than the maximum displacement amount so as to provide a large difference therebetween, erroneous abnormality recognition is more likely to occur. Therefore, a limit may be provided to a minimum value of the threshold value that can be set by a user.

In the present embodiment, control unit 100 calculates (determines) cumulative value CV in advance before starting displacement of registration roller pair 53*a*, and determines whether or not determined cumulative value CV exceeds the threshold value. As a specific example, control unit 100 identifies a direction and an amount of deviation of a side edge of sheet S that is being conveyed by registration roller pair 53*a* from, e.g., an output signal from line sensor 54, and regards the identified deviation amount as a displacement amount for registration roller pair 53*a*. Then, if registration roller pair 53*a* is displaced a plurality of (N) times for sheet S, control unit 100 sums up the amounts of deviation of sheet S from the first to N-th times to calculate cumulative value CV.

If control unit 100 determines that cumulative value CV exceeds the threshold value, control unit 100 can perform various types of control. As one specific example, if control unit 100 determines that cumulative value CV exceeds the threshold value, control unit 100 performs control to stop displacement of registration roller pair 53*a* for sheet S.

Here, for the "stoppage" of the displacement, control unit 100 causes registration roller pair 53*a* to be displaced in a range in which cumulative value CV does not exceed the threshold value in the deviation amount identified as described above and subsequently does not cause registration roller pair 53*a* to be displaced irrespective of whether or not there is positional deviation of sheet S. As another example of the stoppage of the displacement, control unit 100 may prevent registration roller pair 53*a* from being displaced after control unit 100 determines that cumulative value CV exceeds the threshold value.

The above control to stop displacement enables preventing, e.g., the motor that transmits a motive force for displacement of registration roller pair 53*a* from being damaged.

If control unit 100 determines that cumulative value CV exceeds the threshold value and stops the displacement of registration roller pair 53*a*, control unit 100 performs control to continue conveyance of sheet S. This control enables collecting sheet S without stopping the relevant job.

As another example, if control unit 100 determines that cumulative value CV exceeds the threshold value, and control unit 100 stops the displacement of registration roller pair 53*a*, control unit 100 performs abnormal stop control to immediately stop the conveyance of sheet S and operation for the relevant print job. In a case where a failure such as a jam may occur if conveyance of sheet S is continued, such control enables preventing such failure. When this abnormal stop control is performed, control unit 100 also performs control for a service call. As the control for a service call, for example, control unit 100 notifies an administrator (customer engineer) of the abnormality via communication unit 71.

Alternatively, if cumulative value CV for each of a plurality of (N) sheets S successively conveyed exceeds the threshold value, control unit 100 performs control to stop the displacement and continue the conveyance for up to an (N−1)-th sheet and performs the above-described abnormal stop control for N-th sheet S. A value of N can be set (selected) in advance by a user through, e.g., a non-illustrated user setting screen.

Also, if control unit 100 determines that cumulative value CV exceeds the threshold value, various messages according to the above-described content of control may be displayed on operation display unit 20 or a display section of an external apparatus (e.g., a PC) connected to image forming apparatus 1. Examples of the messages displayed on the display section include, e.g., a message to the effect that positional deviation of the sheet cannot be corrected and a message to the effect that the state of image forming apparatus 1 needs to be improved. Here, examples of the message to the effect that the state of image forming apparatus 1 should be improved include a message urging improvement of handling of sheets S such as "make sure sheets are set properly".

As another example, in a case where a sheet feeding apparatus for long sheets is connected to image forming apparatus 1, if cumulative value CV becomes large or if a displacement amount for one displacement of registration roller pair 53*a* is continuously large, it is highly probable that the sheet feeding apparatus is misaligned. Therefore, if control unit 100 determines that cumulative value CV exceeds the threshold value in such case, control unit 100 causes a message such as "since sheets have obliqueness, please adjust the position of the sheet feeding apparatus" to be displayed on the display section.

The above control enables notifying, e.g., a user of various failures, that is, the state of, e.g., sheets S or image forming apparatus 1 being not normal.

Which of the above-described types of control to perform if it is determined that cumulative value CV exceeds the threshold value can be set (selected) by a user in advance through, e.g., the user setting screen.

An example of operation for control of displacement of registration roller pair 53*a*, thus, sheet S in image forming apparatus 1 will be described below with reference to the flowchart in FIG. 12. Here, assuming a case where printing is performed on long sheets having a size that is long (for example, exceeding 487.7 mm) in the conveyance direction as sheets S, example control in execution of a print job where the aforementioned sheet feeding apparatus for long sheets is connected to image forming apparatus 1 will be described.

At the time of execution of the print job, control unit 100 starts conveyance of sheet S and waits until a front end in the conveyance direction of sheet S enters the registration nip formed by registration roller pair 53*a* (NO in step S500). Upon the front end of sheet S entering the registration nip (YES in step S500), control unit 100 proceeds to step S520.

In step S520, control unit 100 activates line sensor 54 at a timing after the entry of the front end in the conveyance direction of sheet S to the registration nip to detect a position of a side edge of sheet S and determines whether or not positional deviation of sheet S occurs.

If control unit 100 determines that no positional deviation of the side edge of sheet S occurs (NO in step S520), control unit 100 determines whether or not a rear end in the conveyance direction of sheet S passes through the registration nip (step S540). Here, as long as the rear end of sheet S does not pass through the registration nip, control unit 100 repeats determination of whether or not positional deviation of sheet S occurs (NO in step S520, and step S640), and if control unit 100 determines that positional deviation of sheet S occurs (YES in step S520), control unit 100 proceeds to step S540.

In step S540, control unit 100 identifies a direction and an amount of the deviation of the side edge of sheet S.

Subsequently, control unit 100 calculates cumulative value CV of displacement amount (amount of movement in the width direction) of registration roller pair 53*a* for sheet S (step S560). More specifically, in step S560, prior to displacement operation of registration roller pair 53*a*, control unit 100 regards the direction and the amount of deviation identified in step S540 as a displacement amount of registration roller pair 53*a* for sheet S and adds the displacement amount to cumulative value CV of displacement.

In step S580, control unit 100 determines whether or not calculated cumulative value CV is equal to or below the above-described threshold value.

Here, if control unit 100 determines that cumulative value CV is equal to or below the threshold value (YES in step S580), control unit 100 regards no abnormality as occurring and performs displacement operation of registration roller pair 53*a* (step S600), and proceeds to step S640 described above. More specifically, in step S600, control unit 100 performs control so as to displace (move) registration roller pair 53*a* in a direction that is opposite to the identified deviation direction, that is, a direction in which the positional deviation of the side edge of sheet S is corrected, and upon registration roller pair 53*a* being moved by an amount corresponding to the identified deviation amount, stop the operation for the movement.

On the other hand, if control unit 100 determines that cumulative value CV is neither equal to nor below the threshold value (that is, exceeds the threshold value) (NO in step S580), control unit 100 regards any sort of abnormality as occurring, and stops the displacement of registration roller pair 53*a* and continues the conveyance of sheet S (step S620), and proceeds to step S640.

Consequently, until control unit 100 determines that the rear end of sheet S passes through the registration nip (YES in step S640), control unit 100 repeats the above-described processing in steps S520 to S620, enabling a plurality of registration displacements to be performed for one sheet S.

Also, prior to registration displacement for second positional deviation onwards of sheet S, control unit 100 updates cumulative value CV of displacement amount in each time in step S560. For example, where the first positional deviation of sheet S is deviation of 2 (mm) to the back side of the apparatus and the second positional deviation is deviation of 1 (mm) to the back side of the apparatus, control unit 100 updates the cumulative value of displacement amount to 2+1=3 (mm). On the other hand, where the first positional deviation of sheet S is deviation of 2 (mm) to the back side of the apparatus and the second positional deviation is deviation of 1 (mm) to the near side of the apparatus (in the case of what is called meandering), control unit 100 updates cumulative value CV of displacement amount to 2+(−1)=1 (mm).

In this way, until sheet S entered the registration nip passes through the registration nip, each time positional deviation is detected (YES in step S520), control unit 100 updates cumulative value CV of displacement of registration roller pair 53*a* and compares the updated value with the threshold value, thereby monitoring whether or not, e.g., an abnormality occurs.

Then, if control unit 100 determines that the rear end of sheet S passes through the registration nip (YES in step S640), control unit 100 performs control to return registration roller pair 53*a* to a home position, and at this time, resets cumulative value CV by deleting (destroying) cumulative value CV from a memory (step S660).

In subsequent step S680, control unit 100 determines whether or not the print job ends. If control unit 100 determines that the print job does not end (NO in step S680), control unit 100 returns to step S500 and performs the above-described processing in S500 onwards for subsequent sheet S. On the other hand, if control unit 100 determines that the print job ends (YES in step S680), control unit 100 ends the above-described series of processing.

The above control enables, while correcting sub scanning obliqueness of sheet S, finding an irregular state of image forming apparatus 1 before, e.g., damage occurring in the apparatus, enabling taking various countermeasures.

Alterations of the above-described configuration and control will be described below.

The above example is premised on a case where a direction and an amount of deviation of sheet S cannot be estimated, and has been described in terms of example control in which displacement of registration roller pair 53*a* is started based on a result of detection of a position of a side edge of sheet S by line sensor 54.

On the other hand, where a direction in which sheet S deviates is known in advance (can be estimated) because of, e.g., an idiosyncrasy of the apparatus, displacement of registration roller pair 53*a* can be started without using the result of detection by line sensor 54.

In this case, prior to execution of a print job, values specifying a timing for start (that is, execution timing) of displacement of registration roller pair 53*a* for sheet S and a direction of the displacement (fixed values) are registered in advance in, e.g., a memory as preset values. Then, at the time of execution of the print job, control unit 100 reads the preset values, and when the specified execution timing comes, control unit 100 regards positional deviation of sheet S as occurring (YES in step S520) and performs control to start displacement of registration roller pair 53*a* in the specified direction. Concurrently with the start of the displacement, control unit 100 starts recording or updating of cumulative value CV described above (see step S560) and determines whether or not cumulative value CV is equal to or below a threshold value (see step S580).

Also, after the start of the displacement of registration roller pair 53*a*, control unit 100 performs control to stop the displacement of registration roller pair 53*a*, using a result of detection by line sensor 54. For example, after the start of the displacement of registration roller pair 53*a*, control unit 100 activates line sensor 54 to monitor an output signal from line sensor 54, and performs control to stop the displacement when a side edge of sheet S reaches a target position. Here, during the displacement of registration roller pair 53*a*, if control unit 100 determines that cumulative value CV exceeds the threshold value, control unit 100 stops the displacement of registration roller pair 53*a* (see NO in step S580, and step S620).

Also, if not only a direction of deviation of sheet S but also an amount of the deviation is known in advance (can be estimated), in addition to a timing for starting displacement of registration roller pair 53*a* for sheet S and a direction of the displacement, a displacement amount for each timing for starting displacement can be specified as a preset value. In this case, control unit 100 can calculate cumulative value CV at a stage of preset values being read, and thus, control unit 100 can, for example, perform determination of whether or not cumulative value CV is equal to or below the threshold value (see step S580) and provide the above-described message display where cumulative value CV exceeds the threshold value, prior to conveyance of sheet S.

For simplicity, the above example has been described in terms of an example in which cumulative value CV of displacement of registration roller pair 53*a* is compared with one threshold value. As another example, for the threshold value, a first threshold value before entry of sheet S to the secondary transfer nip and a second threshold value after entry of sheet S to the secondary transfer nip may be set separately.

In other words, in general, control of registration displacement before entry of sheet S to the secondary transfer nip (hereinafter referred to as "pre-transfer displacement") is performed mainly for correcting an offset of sheet S due to, e.g., a mechanical factor. Also, in pre-transfer displacement, unless the above-described maximum displacement amount is reached, no problem is likely to occur even if registration roller pair 53*a* is relatively largely displaced.

On the other hand, control for registration displacement after entry of sheet S to the secondary transfer nip (hereinafter referred to as "in-transfer displacement") includes the idea of correcting sub scanning obliqueness of sheet S. Here, an increase of a cumulative value (CV) in in-transfer displacement indicates that an amount or an angle of obliqueness of sheet S is large, and thus, there is a fear of, e.g., occurrence of a jam of sheet S or any device inside image forming apparatus 1 or installation of apparatuses relative to each other (e.g., connection between the apparatuses) may not be normal. In other words, during in-transfer displacement, in comparison with pre-transfer displacement, e.g., an abnormality of the apparatus can easily be detected by monitoring a cumulative value (CV). In addition, in in-transfer displacement, a toner image is being transferred onto sheet S, and thus, even if a maximum displacement amount is not reached, an image defect may be generated when registration roller pair 53*a* is largely displaced at one time.

In view of such circumstances above, for a threshold value that serves as a reference for stopping displacement of registration roller pair 53*a*, a value for pre-transfer displacement (first threshold value) and a value for in-transfer displacement (second threshold value) may be provided separately.

In this case, control unit 100 determines whether or not the cumulative value exceeds the first threshold value, before entry of sheet S to the secondary transfer nip, and determines whether or not the cumulative value exceeds the second threshold value, after entry of sheet S to the secondary transfer nip.

Each of the first threshold value and the second threshold value can be set to be a value that is equal to or below the above-described maximum displacement amount, and can be set by inputting the relevant value to a non-illustrated user setting screen. Therefore, the first threshold value and the second threshold value can be set to be values that are different from each other or may be set to be a same value.

An example of setting of the first and second threshold values and an example of processing by control unit 100 where it is assumed that a maximum displacement amount for registration roller pair 53*a* is a distance of 10 will be described below.

Upon pre-transfer displacement being performed for sheet S, a mechanical/physical restriction in subsequent in-transfer displacement (what is called apparent maximum displacement amount) varies. More specifically, for example, in pre-transfer displacement, if registration roller pair 53*a* is moved by a distance of 5, registration roller pair 53*a* can be moved in a direction that is the same as that of the pre-transfer displacement by a distance of 5 only in subsequent in-transfer displacement, but can be displaced by a distance of 15 in a direction opposite to the direction of the pre-transfer displacement.

Therefore, as an example of setting of the respective threshold values, maximum displacement amount≥first threshold value+second threshold value. In this case, control unit 100 may calculate a cumulative value of displacement of registration roller pair 53*a* before and after entry of sheet S to the secondary transfer nip separately and determine whether the calculated cumulative value exceeds the first threshold value (or the second threshold value) (see step S580).

On the other hand, if setting is made so that maximum displacement amount≥first threshold value (or second threshold value), after entry of sheet S to the secondary transfer nip, control unit 100 determines whether or not the maximum displacement amount for registration roller pair 53*a* is reached, in addition to the above-described processing. Then, if control unit 100 determines that the maximum displacement amount is reached, control unit 100 performs control to stop the displacement.

Figure 12:
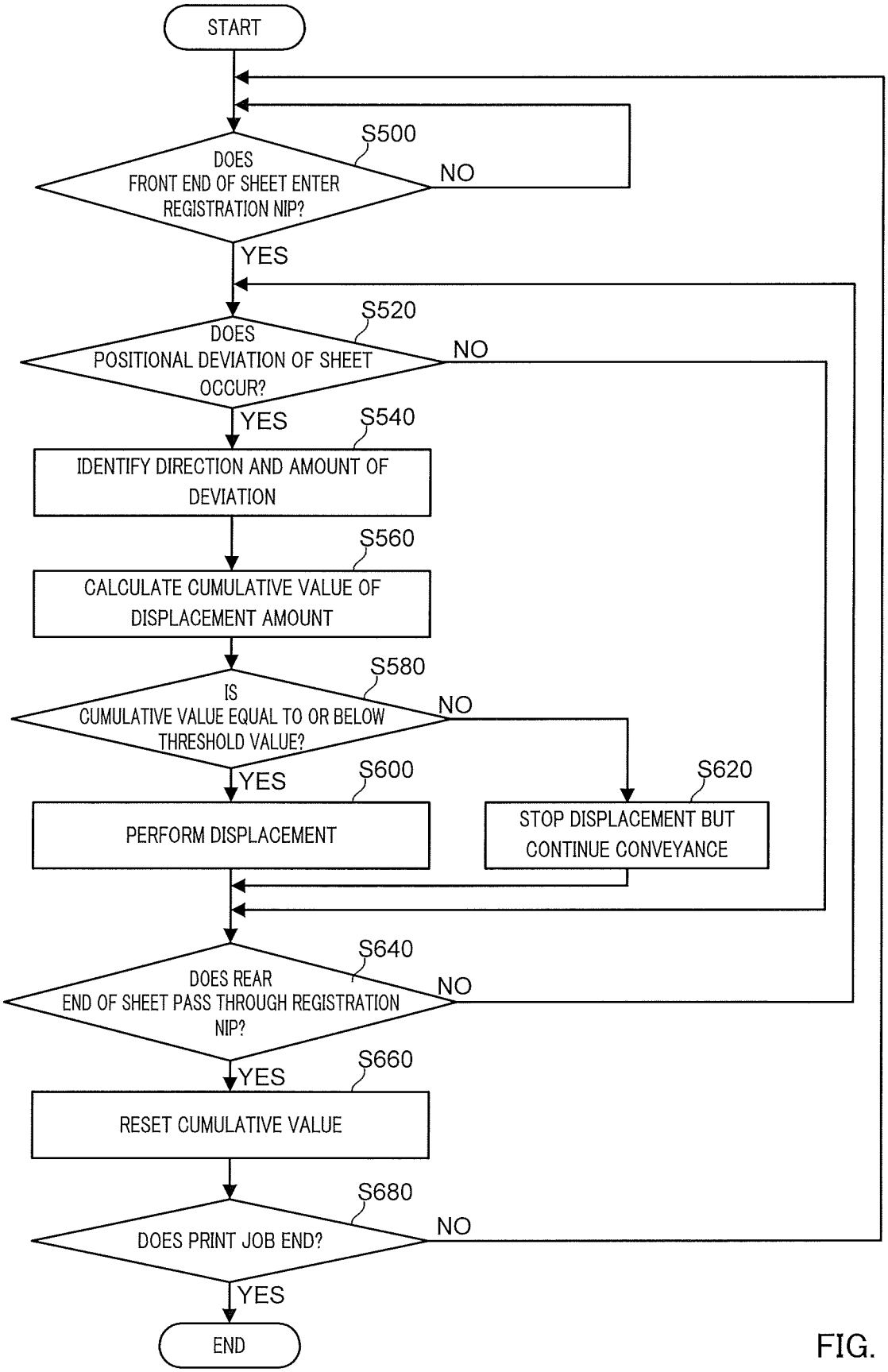
FIG. 12 is a flowchart illustrating an example of conveyance control for registration displacement in the image forming apparatus according to Embodiment 3.

The flowchart in FIG. 12 has been described as an example of control after entry of sheet S to the registration nip until sheet S passes through the registration nip. As another example, the flowchart in FIG. 12 may be employed as control after entry of sheet S to the secondary transfer nip until sheet S passes through the registration nip, that is, control during image transfer. In this case, the "registration nip" in step S500 may be replaced with "secondary transfer nip".

As described in detail above, image forming apparatus 1 according to the present embodiment enables early finding a defect in the apparatus and/or sheet S while correcting sub scanning obliqueness of the sheet.

[Supplement] According to Embodiment 3 described above, the technical ideas and configurations stated in [1] to [12] below can be derived.

[1] Control unit 100 causes a sheet conveying member (53*a*) to be displaced a plurality of times for sheet S, and if a cumulative value of displacement amount exceeds a threshold value, stops the displacement of the sheet conveying member (53*a*) for sheet S.

[2] In the configuration in [1] above, control unit 100 calculates the cumulative value prior to the displacement of the sheet conveying member (53*a*), and determines whether or not the calculated cumulative value exceeds the threshold value.

[3] In the configuration in [1] or [2] above, for the threshold value, a value that is equal to or below a maximum displacement amount for the sheet conveying member (53*a*) can be selected.

[4] In the configuration in any of [1] to [3] above, if the cumulative value exceeds the threshold value, control unit 100 performs control to stop the displacement of the sheet conveying member (53*a*) and continue conveyance of sheet S.

[5] In the configuration in any of [1] to [3] above, if the cumulative value exceeds the threshold value, control unit 100 performs control to abnormally stop image forming apparatus 1.

[6] In the configuration in any of [1] to [5] above, for the threshold value, a value before entry of sheet S to a transfer section (421, 423B, 424) and a value after entry of sheet S to the transfer section (421, 423B, 424) are set, respectively.

[7] In the configuration in any of [1] to [6] above, control unit 100 displaces the sheet conveying member (53*a*) by a displacement amount according to a result of detection by a detection section (54) that detects a position of an end in a width direction of sheet S.

[8] In the configuration in any of [1] to [6] above, control unit 100 performs control of the displacement, using a preset value specifying an execution timing for the displacement.

[9] In the configuration in [6] above, after a start of the displacement of the sheet conveying member (53*a*), control unit 100 activates a detection section (54) that detects a position of an end in the width direction of sheet S, and if the end of sheet S reaches a target position, stops the displacement.

[10] In the configuration in [5] above, if each of the cumulative values of N (N≥2) sheets S conveyed successively exceeds the threshold value, control unit 100 performs the control to abnormally stop N-th sheet S.

[11] In the configuration in [10] above, in the abnormal stop, control unit 100 performs control for a service call.

[12] In the configuration in any of [1] to [11] above, if the cumulative value exceeds the threshold value, control unit 100 displays a message to an effect that a state of image forming apparatus 1 needs to be improved, on a display unit (21).

In each of the above embodiments has been described in terms of an example of an image forming apparatus including a transfer section that secondarily transfers an image to be printed, onto sheet S using intermediate transfer belt 421. However, the above embodiments are applicable also to image forming apparatuses of a transfer type in which an image to be printed is primarily transferred onto sheet S (for example, a monochrome printer, an inkjet printer, etc.).

Each of the above embodiments has been described in terms of a case where a sheet conveying member provided upstream of a secondary transfer nip, the sheet conveying member being subjected to displacement control by control unit 100, is registration roller pair 53*a*. As another example, for the sheet conveying member, for example, a roller other than registration roller pair 53*a*, a sheet conveying guide, etc., can be employed additionally or alternatively.

Each of the above embodiments has been described in terms of an example of an image forming apparatus including a transfer section that secondarily transfers an image to be printed, onto sheet S using intermediate transfer belt 421. However, the above embodiments are applicable also to image forming apparatuses of a transfer type in which an image to be printed is primary-transferred onto sheet S (for example, a monochrome printer, an inkjet printer, etc.).

Each of the above embodiments has been described in terms of a case where flat sheets are used as sheets S. However, the above embodiments are applicable also to rolled sheets.

The above-described configurations in Embodiments 1 to 3 can arbitrarily be combined.

Although embodiments of the present invention have been described and illustrated in detail, the disclosed embodiments are made for purpose of illustration and example only and not limitation. The scope of the present invention should be interpreted by terms of the appended claims.

What is claimed is:

1. An image forming apparatus comprising:

a transferrer that transfers an image onto a sheet;

a sheet conveyer that conveys the sheet, the sheet conveyer being provided upstream of the transferrer in a sheet conveyance direction; and a hardware processor that controls displacement of the sheet conveyer so that the sheet is displaced along a width direction of the sheet, wherein the hardware processor sets a displacement speed of the sheet conveyer for the sheet during transfer of the image by the transferrer to be lower than the displacement speed of the sheet conveyer for the sheet before the transfer of the image by the transferrer, the sheet conveyor moving along the width direction of the sheet at the displacement speed during the transfer of the image by the transferrer.

2. The image forming apparatus according to claim 1, wherein the hardware processor sets the displacement speed of the sheet conveyer to be lower than a sheet conveyance speed in the transferrer.

3. The image forming apparatus according to claim 2, wherein the hardware processor sets the displacement speed of the sheet conveyer to be higher than a speed of deviation of the sheet in the width direction.

4. The image forming apparatus according to claim 1, wherein the hardware processor causes a drive source that transmits a drive force for the displacement to the sheet conveyer to operate at a self-excitation frequency.

5. The image forming apparatus according to claim 1, wherein the hardware processor sets a speed of return operation to return the sheet conveyer to an initial position to be higher than the displacement speed during the transfer of the image.

6. The image forming apparatus according to claim 1, wherein where the sheet conveyer is displaced a plurality of times for the sheet, the hardware processor sets the displacement speed during the transfer of the image for each displacement.

7. The image forming apparatus according to claim 6, wherein the hardware processor sets different displacement speeds for each of the plurality of times the sheet conveyor is displaced.

8. The image forming apparatus according to claim 7, wherein the hardware processor sets the displacement speed to be lower on a more downstream side in the conveyance direction of the sheet.

9. The image forming apparatus according to claim 1, wherein the hardware processor controls the displacement of the sheet conveyer, using a table in which a value of the displacement speed is registered.

10. The image forming apparatus according to claim 9, wherein the table is provided corresponding to a type of sheet.

11. The image forming apparatus according to claim 9, wherein the table is provided corresponding to a temperature and humidity around the image forming apparatus.

12. The image forming apparatus according to claim 9, wherein the table is provided for each of a front side and a back side of the sheet.

13. The image forming apparatus according to claim 9, wherein the table is provided corresponding to a sheet feed tray.

14. The image forming apparatus according to claim 1, wherein the hardware processor changes the displacement speed according to a displacement amount of the sheet conveyer.

15. The image forming apparatus according to claim 1, comprising a user setter that allows setting the displacement speed during the transfer of the image.

16. The image forming apparatus according to claim 1, wherein the hardware processor changes the displacement speed during the transfer of the image for a next sheet, according to a result of reading the image on the sheet.

17. The image forming apparatus according to claim 1, wherein the hardware processor changes the displacement speed during the transfer of the image, according to a result of detection by a loop detector that detects an amount of a loop of the sheet in a loop forming space between the transferrer and the sheet conveyer.

18. The image forming apparatus according to claim 1, wherein the hardware processor controls the displacement of the sheet conveyer so as to eliminate deviation from a target position, and performs one displacement operation of the sheet conveyer for the sheet during the transfer of the image by the transferrer with a displacement amount that is equal to or below a predetermined displacement amount threshold value so as to prevent transfer deviation of the image.

19. The image forming apparatus according to claim 18, wherein the hardware processor causes the sheet conveyer to be displaced a plurality of times for the sheet, and if a cumulative value of displacement amount exceeds the threshold value, stops the displacement of the sheet conveyer for the sheet.

20. A conveyance control method for an image forming apparatus including a transferrer that transfers an image onto a sheet and a sheet conveyer that conveys the sheet, the sheet conveyer being provided upstream of the transferrer in a sheet conveyance direction, the sheet conveyer being displaced so that the sheet is displaced along a width direction of the sheet, the method comprising:

setting a displacement speed of the sheet conveyer for the sheet during transfer of the image by the transferrer to be lower than the displacement speed of the sheet conveyer for the sheet before the transfer of the image by the transferrer, the sheet conveyor moving along the width direction of the sheet at the displacement speed during the transfer of the image by the transferrer.

* * * * *